US009336941B1

(12) United States Patent
Ikriannikov

(10) Patent No.: US 9,336,941 B1
(45) Date of Patent: May 10, 2016

(54) MULTI-ROW COUPLED INDUCTORS AND ASSOCIATED SYSTEMS AND METHODS

(71) Applicant: Volterra Semiconductor Corporation, Fremont, CA (US)

(72) Inventor: Alexandr Ikriannikov, Castro Valley, CA (US)

(73) Assignee: Volterra Semiconductor LLC, San Jose, CA (US)

( * ) Notice: Subject to any disclaimer, the term of this patent is extended or adjusted under 35 U.S.C. 154(b) by 160 days.

(21) Appl. No.: 14/067,718

(22) Filed: Oct. 30, 2013

(51) Int. Cl.
*H01F 27/24* (2006.01)
*H01F 27/29* (2006.01)

(52) U.S. Cl.
CPC ..... *H01F 27/29* (2013.01)

(58) Field of Classification Search
None
See application file for complete search history.

(56) References Cited

U.S. PATENT DOCUMENTS 2,403,393 A 7/1946 Peterson
3,413,580 A * 11/1968 Gibas ..... H01F 7/08 335/279
3,671,847 A 6/1972 Shibano
4,488,136 A 12/1984 Hansen et al.
5,003,277 A 3/1991 Sokai et al.
5,177,460 A 1/1993 Dhyanchand et al.
5,182,535 A 1/1993 Dhyanchand
5,353,001 A 10/1994 Meinel et al.
6,018,468 A 1/2000 Archer et al.
6,060,977 A 5/2000 Yamamoto et al.
6,348,848 B1 2/2002 Herbert
6,362,986 B1 3/2002 Schultz et al.
6,377,155 B1 4/2002 Allen et al.
6,388,896 B1 5/2002 Cuk
6,420,953 B1 7/2002 Dadafshar
6,867,678 B2 * 3/2005 Yang ..... H01F 27/2804 336/200
6,980,077 B1 12/2005 Chandrasekaran et al.
7,199,695 B1 4/2007 Zhou et al.
7,239,530 B1 7/2007 Djekic et al.
7,259,648 B2 8/2007 Matsutani et al.
7,317,305 B1 1/2008 Stratakos et al.
7,352,269 B2 4/2008 Li et al.
7,417,875 B2 * 8/2008 Chandrasekaran H02M 3/33592 323/356
7,425,883 B2 9/2008 Matsutani et al.
7,498,920 B2 3/2009 Sullivan et al.
7,567,163 B2 7/2009 Dadafshar et al.
7,649,434 B2 1/2010 Xu et al.
7,994,888 B2 8/2011 Ikriannikov
2005/0024179 A1 * 2/2005 Chandrasekaran ..... H01F 27/24 336/212
2006/0197510 A1 9/2006 Chandrasekaran
2008/0024259 A1 1/2008 Chandrasekaran et al.
2008/0150666 A1 6/2008 Chandrasekaran et al.
2009/0179723 A1 7/2009 Ikriannikov et al.

(Continued)

*Primary Examiner* — Elvin G Enad
*Assistant Examiner* — Ronald Hinson
(74) *Attorney, Agent, or Firm* — Lathrop & Gage LLP

(57) ABSTRACT

A multi-row coupled inductor has length, width, and height and includes a magnetic core including (1) opposing first and second plates separated from each other in the height direction, and (2) one or more pairs of coupling teeth. Each of the one or more pairs is separated from each other in the widthwise direction, and each of the one or more pairs includes a first coupling tooth and a second coupling tooth separated from and opposing each other in the lengthwise direction. The multi-row coupled inductor further includes: (1) a respective first winding wound around the first coupling tooth, and (2) a respective second winding wound around the second coupling tooth. The first winding mirrors the second winding in each of the one or more pairs, when seen looking toward the magnetic core cross-sectionally in the height direction.

13 Claims, 23 Drawing Sheets

(56) References Cited

U.S. PATENT DOCUMENTS

| | | | | |
|---|---|---|---|---|
| 2009/0231081 | A1 | 9/2009 | Ikriannikov et al. | |
| 2009/0237197 | A1 | 9/2009 | Ikriannikov et al. | |
| 2010/0007457 | A1* | 1/2010 | Yan | H01F 3/14 336/234 |
| 2011/0018669 | A1 | 1/2011 | Ikriannikov | |
| 2011/0032068 | A1 | 2/2011 | Ikriannikov | |
| 2011/0035607 | A1 | 2/2011 | Ikriannikov | |
| 2011/0043317 | A1 | 2/2011 | Ikriannikov | |
| 2011/0148559 | A1 | 6/2011 | Ikriannikov | |
| 2011/0148560 | A1 | 6/2011 | Ikriannikov | |
| 2011/0169476 | A1 | 7/2011 | Ikriannikov | |
| 2011/0260822 | A1 | 10/2011 | Ikriannikov | |
| 2011/0279100 | A1 | 11/2011 | Ikriannikov | |
| 2011/0286143 | A1 | 11/2011 | Ikriannikov | |
| 2011/0286144 | A1 | 11/2011 | Ikriannikov | |
| 2012/0056704 | A1 | 3/2012 | Nagano et al. | |
| 2012/0098632 | A1 | 4/2012 | Markowski et al. | |

* cited by examiner

MULTI-ROW COUPLED INDUCTORS AND ASSOCIATED SYSTEMS AND METHODS

BACKGROUND

It is known to electrically couple multiple switching sub-converters in parallel to increase switching power converter capacity and/or to improve switching power converter performance. One type of switching power converter with multiple switching sub-converters is a "multi-phase" switching power converter, where the switching sub-converters switch out-of-phase with respect to each other. Such out-of-phase switching results in ripple current cancellation at the converter output filter and allows the multi-phase switching power converter to have a better transient response than an otherwise similar single-phase switching power converter. Examples of multi-phase switching power converters include, but are not limited to, multi-phase buck converters, multi-phase boost converters, and multi-phase buck-boost converters.

As taught in U.S. Pat. No. 6,362,986 to Schultz et al., which is incorporated herein by reference, a multi-phase switching power converter's performance can be improved by magnetically coupling the energy storage inductors of two or more phases. Such magnetic coupling results in ripple current cancellation in the inductors and increases ripple switching frequency, thereby improving converter transient response, reducing input and output filtering requirements, and/or improving converter efficiency, relative to an otherwise identical converter without magnetically coupled inductors. The inductors must be inversely magnetically coupled, however, to realize the advantages of using coupled inductors, instead of multiple discrete inductors, in the multi-phase switching power converter. Inverse magnetic coupling is characterized by current flowing through a winding from a respective switching node to a common node inducing current flowing in each other magnetically coupled winding from a respective switching node to the common node.

Two or more magnetically coupled inductors are often collectively referred to as a "coupled inductor" and have associated leakage inductance and magnetizing inductance values. Magnetizing inductance is associated with magnetic coupling between windings; thus, the larger the magnetizing inductance, the stronger the magnetic coupling between windings. Leakage inductance, on the other hand, is associated with energy storage. Thus, the larger the leakage inductance, the more energy stored in the inductor. Leakage inductance results from leakage magnetic flux, which is magnetic flux generated by current flowing through one winding of the inductor that is not coupled to the other windings of the inductor.

As taught in Schultz et al., large magnetizing inductance values are desirable to better realize the advantages of using a coupled inductor, instead of discrete inductors, in a switching power converter. Leakage inductance values, on the other hand, typically must be within a relatively small range of values. In particular, leakage inductance must be sufficiently large to prevent excessive ripple current magnitude, but not so large that converter transient response suffers. Transformers, in contrast to coupled inductors, are normally designed to minimize leakage inductance and associated energy storage, because energy storage is normally undesirable in transformers.

Coupled inductors including a row of magnetically coupled windings have been developed. For example, FIG. 1 is a perspective view of a prior art coupled inductor 100 having a length 102, a width 104, and a height 106. Coupled inductor 100 includes a magnetic core 108 including a first plate 110, a second plate 112, and a plurality of coupling teeth 114. FIG. 2 is an exploded perspective view of coupled inductor 100 showing second plate 112 separated from the remainder of coupled inductor 100. First plate 110 and second plate 112 are separated from and oppose each other in the height 106 direction. Each coupling tooth 114 is disposed between first plate 110 and second plate 112 in the height 106 direction. A respective winding 116 is wound around each coupling tooth 114, such that windings 116 are disposed in a single row in the widthwise 104 direction.

As another example, FIG. 3 is a perspective view of a prior art coupled inductor 300 having a length 302, a width 304, and a height 306. Coupled inductor 300 includes a ladder magnetic core 308 including a first rail 310 and a second rail 312 opposing each other and separated in the lengthwise 302 direction. A plurality of rungs 314 are disposed between first rail 310 and second rail 312 in the lengthwise 302 direction, and a top magnetic element 316 is disposed over rungs 314 to provide a leakage magnetic flux path between first rail 310 and second rail 312. A respective winding 318 is wound around each rung 314, such that windings 318 are disposed in a single row in the widthwise 304 direction. FIG. 4 shows coupled inductor 300 with first rail 310 and top magnetic element 316 removed from coupled inductor 300, and FIG. 5 shows a top plan view of coupled inductor 300. The dashed line in FIG. 5 delineates first rail 310 from top magnetic element 316 to help a viewer distinguish these elements of magnetic core 308. The dashed line, however, does not necessarily represent a discontinuity in magnetic core 308.

SUMMARY

In an embodiment, a multi-row coupled inductor has length, width, and height. The multi-row coupled inductor includes a magnetic core including: (1) opposing first and second plates separated from each other in the height direction, and (2) one or more pairs of coupling teeth. Each of the one or more pairs of coupling teeth is separated from each other in the widthwise direction, and each of the one or more pairs includes a first coupling tooth and a second coupling tooth separated from and opposing each other in the lengthwise direction. The multi-row coupled inductor further includes: (1) a respective first winding wound around the first coupling tooth of each of the one or more pairs, and (2) a respective second winding wound around the second coupling tooth of each of the one or more pairs. The first winding mirrors the second winding in each of the one or more pairs, when seen looking toward the magnetic core cross-sectionally in the height direction.

In an embodiment, a multi-row coupled inductor has length, width, and height. The multi-row coupled inductor includes a magnetic core including: (1) opposing first and second plates separated from each other in the height direction, and (2) first and second coupling teeth separated from and opposing each other in the lengthwise direction. Each of the first and second coupling teeth is disposed between the first and second plates in the height direction. The multi-row coupled inductor further includes a first winding wound around the first coupling tooth and a second winding wound around the second coupling tooth. Opposing ends of the first winding form first and second solder tabs, respectively, and opposing ends of the second winding form third and fourth solder tabs, respectively. Each of the first, second, third, and fourth solder tabs at least partially overlap with each other when seen looking toward the magnetic core cross-sectionally in the widthwise direction.

In an embodiment, a scalable coupled inductor having length, width, and height includes a plurality of multi-row coupled inductors joined in the width direction. Each of the plurality of multi-row coupled inductors includes: (1) a magnetic core including opposing first and second plates separated from each other in the height direction, and (2) first and second coupling teeth separated from and opposing each other in the lengthwise direction. In each of the plurality of multi-row coupled inductors, each of the first and second coupling teeth is disposed between the first and second plates in the height direction. Each of the plurality of multi-row coupled inductors further includes a first winding wound around the first coupling tooth and a second winding wound around the second coupling tooth.

In an embodiment, a multi-row coupled inductor has length, width, and height. The multi-row coupled inductor includes a magnetic core including: (1) opposing first and second plates separated from each other in the length direction, (2) a first row of one or more first coupling teeth, and (3) a second row of one of more second coupling teeth. The first and second rows are separated from and oppose each other in the height direction, and each first coupling tooth and each second coupling tooth are disposed between the first and second plates in the length direction. The multi-row coupled inductor further includes: (1) a respective first winding wound around each of the one or more first coupling teeth of the first row, and (2) a respective second winding wound around each of the one or more second coupling teeth of the second row. Opposing ends of each first winding terminate on a common side of the magnetic core, and opposing ends of each second winding terminate on the common side of the magnetic core.

In an embodiment, a scalable coupled inductor having length, width, and height includes a plurality of multi-row coupled inductors joined in the width direction. Each of the plurality of multi-row coupled inductors includes a magnetic core including: (1) opposing first and second plates separated from each other in the length direction, and (2) first and second coupling teeth separated from and opposing each other in the height direction. In each of the plurality of multi-row coupled inductors: (1) each of the first and second coupling teeth is disposed between the first and second plates in the length direction, (2) a respective winding is wound around each of the first and second coupling teeth, and (3) opposing ends of each winding terminate on a common side of the magnetic core.

In an embodiment, a multi-phase switching power converter includes a multi-row coupled inductor having length, width, and height. The multi-row coupled inductor includes a magnetic core including: (1) opposing first and second plates separated from each other in the height direction, and (2) one or more pairs of coupling teeth. Each of the one or more pairs is separated from each other in the widthwise direction, and each of the one or more pairs includes a first coupling tooth and a second coupling tooth separated from and opposing each other in the lengthwise direction. The multi-row coupled inductor further includes: (1) a respective first winding wound around the first coupling tooth of each of the one or more pairs, and (2) a respective second winding wound around the second coupling tooth of each of the one or more pairs. The first winding mirrors the second winding in each of the one or more pairs, when seen looking toward the magnetic cross-sectionally in the height direction. The multi-phase switching power converter further includes: (1) a respective first switching circuit electrically coupled to an end of each first winding and adapted to repeatedly switch the end between at least two different voltage levels, and (2) a respective second switching circuit electrically coupled to an end of each second winding and adapted to repeatedly switch the end between at least two different voltage levels.

In an embodiment, a multi-phase switching power converter includes a multi-row coupled inductor having length, width, and height. The multi-row coupled inductor includes: (1) a magnetic core including opposing first and second plates separated from each other in the height direction, and (2) first and second coupling teeth separated from and opposing each other in the lengthwise direction. Each of the first and second coupling teeth is disposed between the first and second plates in the height direction. The multi-row coupled inductor further includes a first winding wound around the first coupling tooth and a second winding wound around the second coupling tooth. Opposing ends of the first winding form first and second solder tabs, respectively, and opposing ends of the second winding form third and fourth solder tabs, respectively. Each of the first, second, third, and fourth solder tabs at least partially overlaps with each other when seen looking toward the magnetic core cross-sectionally in the widthwise direction. The multi-phase switching power converter further includes a first and a second switching circuit. Each of the first and second switching circuits is adapted to repeatedly switch an end of a respective one of the first and second windings between at least two different voltage levels.

In an embodiment, a multi-phase switching power converter includes a multi-row coupled inductor having length, width, and height. The multi-row coupled inductor includes a magnetic core including: (1) opposing first and second plates separated from each other in the length direction, (2) a first row of one or more first coupling teeth, and (3) a second row of one of more second coupling teeth. The first and second rows are separated from and oppose each other in the height direction, and each first coupling tooth and each second coupling tooth is disposed between the first and second plates in the length direction. The multi-row coupled inductor further includes: (1) a respective first winding wound around each of the one or more first coupling teeth of the first row, and (2) a respective second winding wound around each of the one or more second coupling teeth of the second row. Opposing ends of each first winding terminate on a common side of the magnetic core, and opposing ends of each second winding terminate on the common side of the magnetic core. The multi-phase switching power converter further includes: a (1) respective first switching circuit electrically coupled to an end of each first winding and adapted to repeatedly switch the end of each first winding between at least two different voltage levels, and (2) a respective second switching circuit electrically coupled to an end of each second winding and adapted to repeatedly switch the end of each second winding between at least two different voltage levels.

DETAILED DESCRIPTION OF THE EMBODIMENTS

Although coupled inductors including a single row of windings, such as coupled inductors 100 and 300 discussed above, can have significant advantages, these coupled inductors have drawbacks in some applications. In particular, disposing windings in a single row causes the coupled inductors to have a relatively large width, particularly if the coupled inductors include a large number of windings. Coupled inductor applications, however, are increasingly requiring small component width, such that the relatively large width of typical conventional coupled inductors may be problematic.

Accordingly, Applicant has developed coupled inductors where the windings are distributed among multiple rows, instead of in a single row. This multi-row configuration may enable the coupled inductors to have a significantly smaller width than single-row coupled inductors of same number of windings and similar magnetic core cross-sectional area. Additionally, certain embodiments of the multi-row coupled inductors disclosed herein achieve significant additional advantages, as discussed below.

Figure 6:
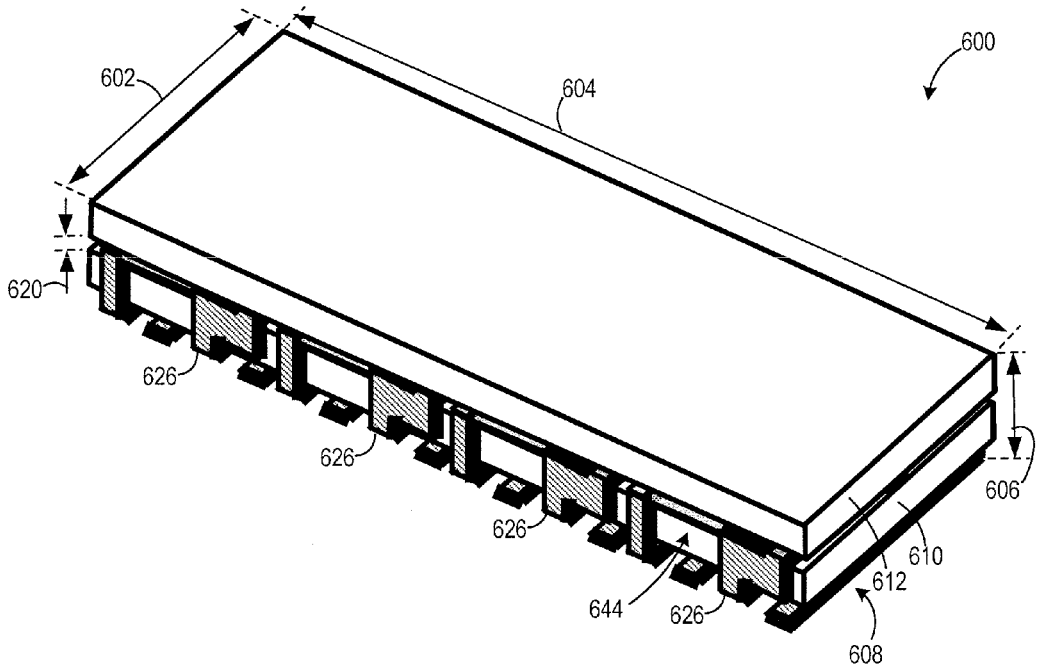
FIG. 6 is a perspective view of a multi-row coupled inductor, according to an embodiment.
Figure 7:
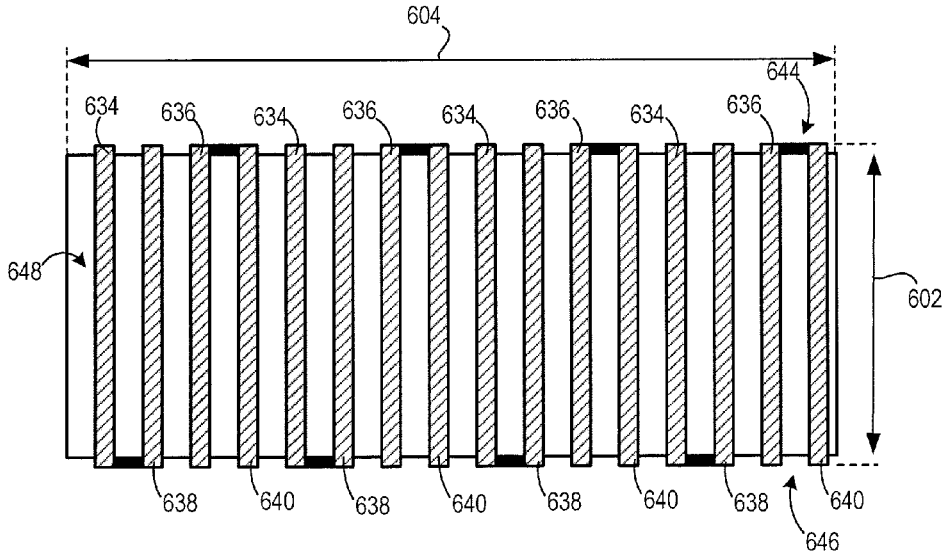
FIG. 7 is a bottom plan view of the FIG. 6 multi-row coupled inductor.
Figure 8:
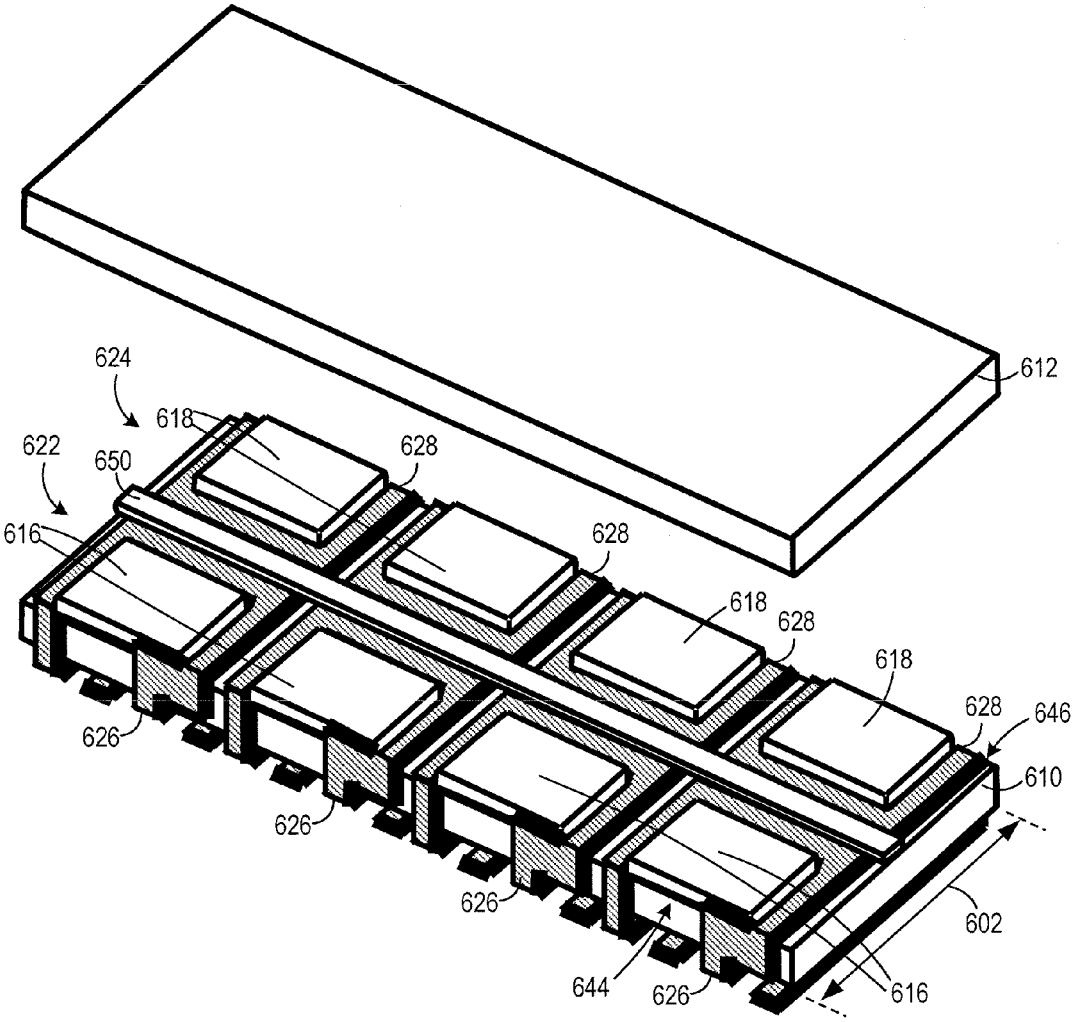
FIG. 8 is an exploded perspective view of the FIG. 6 multi-row coupled inductor showing a second magnetic plate separated from the remainder of the inductor.

FIG. 6 is a perspective view, and FIG. 7 is a bottom plan view, of a multi-row coupled inductor 600 having a length 602, a width 604, and a height 606, which are orthogonal to each other. Coupled inductor 600 includes a magnetic core 608 including a first plate 610 and a second plate 612. FIG. 8 is an exploded perspective view of coupled inductor 600 showing second plate 612 separated from the remainder of coupled inductor 600, and FIG. 9 is an exploded perspective view of magnetic core 608 showing second plate 612 separated from the remainder of magnetic core 608.

Figure 9:
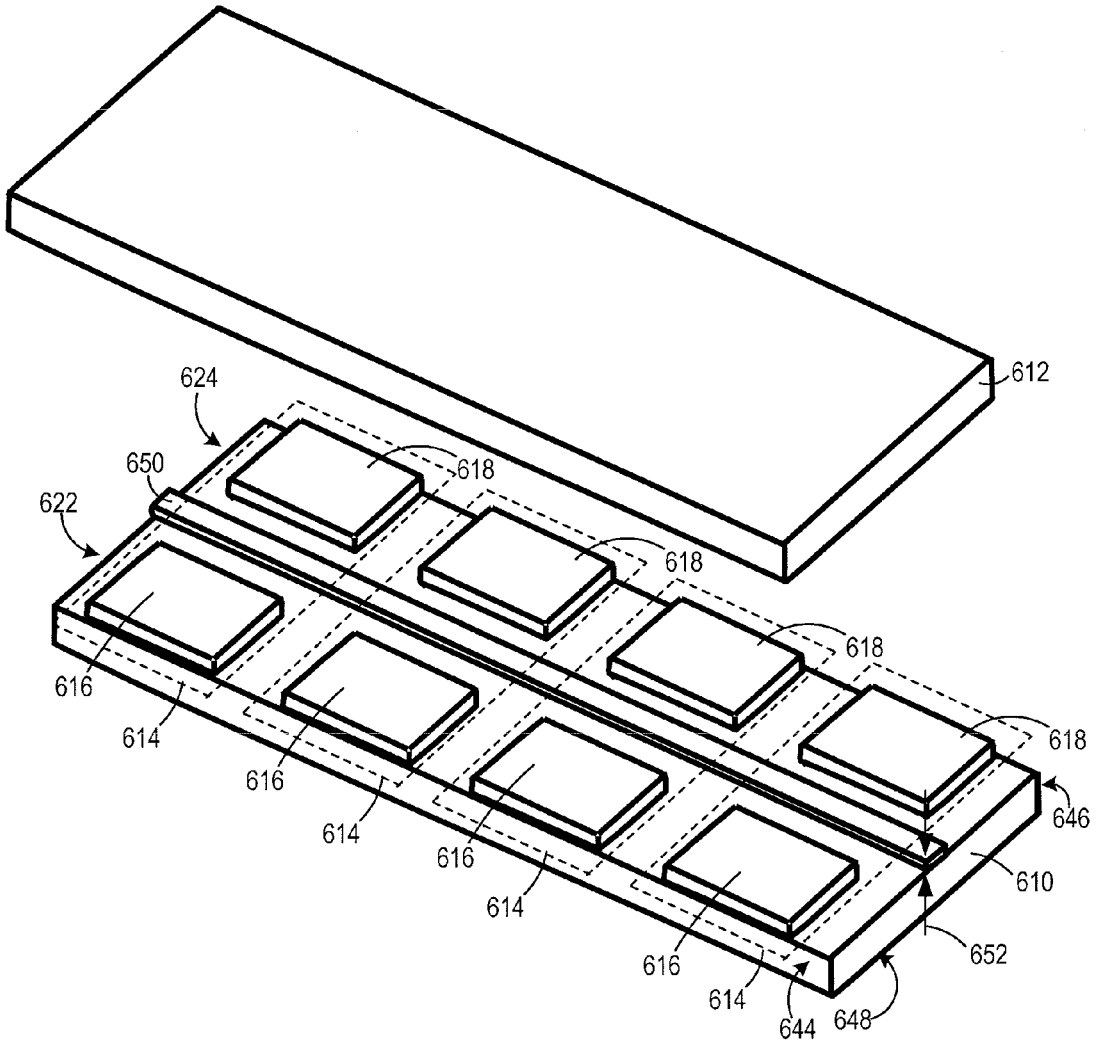
FIG. 9 is an exploded perspective view of the magnetic core of the FIG. 6 multi-row coupled inductor showing the second magnetic plate separated from the remainder of the magnetic core.

As shown in FIG. 9, Magnetic core 608 further includes at least one pair 614 of coupling teeth. Each pair 614 of coupling teeth includes a first coupling tooth 616 and a second coupling tooth 618 separated from and opposing each other in the lengthwise 602 direction. Each first coupling tooth 616 and each second coupling tooth 618 are disposed between first plate 610 and second plate 612 in the height 606 direction, such that each first coupling tooth 616 and each second coupling tooth 618 separate first plate 610 from second plate 612 by a separation distance 620. Each pair 614 of coupling teeth is separated from each other in the widthwise 604 direction, such that all first coupling teeth 616 are disposed in a first row 622 in the widthwise 604 direction, and all second coupling teeth 618 are disposed in a second row 624 in the widthwise 604 direction. Although coupled inductor 600 is shown as including four pairs 614 of coupling teeth, the number of pairs 614 could be varied without departing from the scope hereof. For example, some alternate embodiments include only a single pair 614 of coupling teeth, as discussed below. Additionally, some alternate embodiments could include more than four pairs 614 of coupling teeth.

Figure 10:
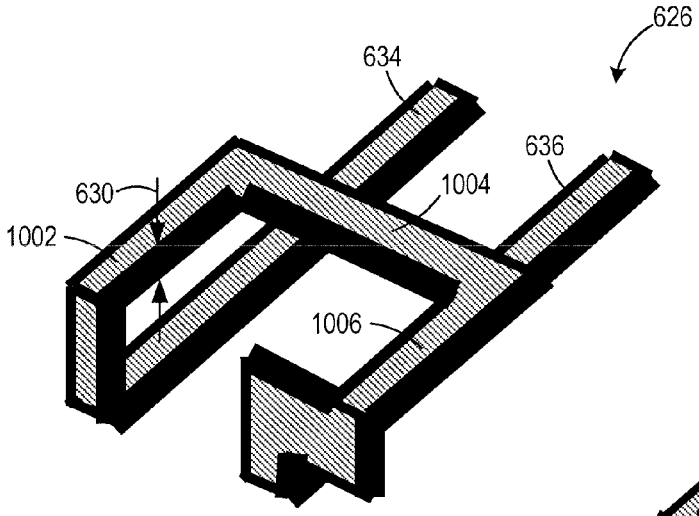
FIG. 10 is a perspective view of one instance of a first winding of the FIG. 6 multi-row coupled inductor.
Figure 11:
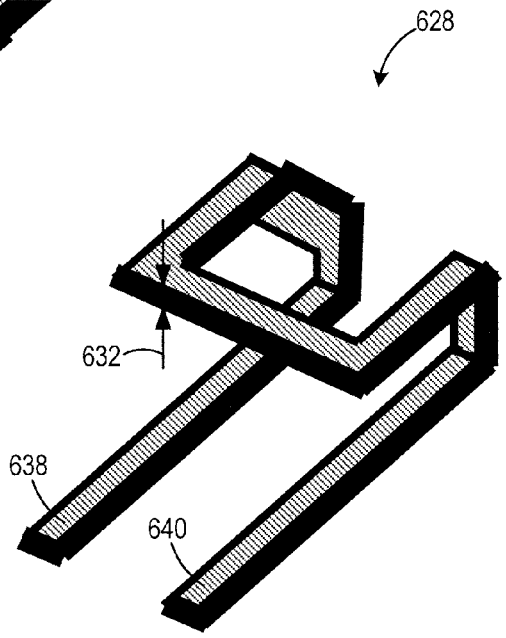
FIG. 11 is a perspective view of one instance of a second winding of the FIG. 6 multi-row coupled inductor.
Figure 12:
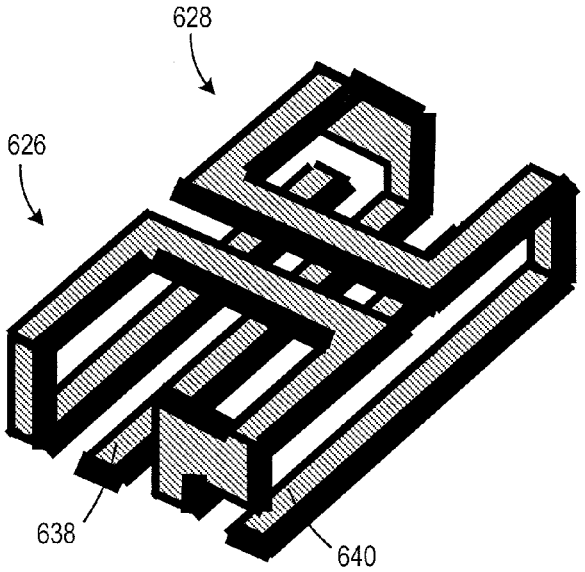
FIG. 12 is a perspective view of a pair of opposing windings of the FIG. 6 multi-row coupled inductor when separated from the coupled inductor, but retaining their relative positions within the coupled inductor.

As shown in FIG. 8, a respective first winding 626 is wound around each first coupling tooth 616, and a respective second winding 628 is wound around each second coupling tooth 618, thereby forming two winding rows separated from each other in the lengthwise 602 direction. FIG. 10 is a perspective view of one first winding 626 instance, and FIG. 11 is a perspective view of one second winding 628 instance. FIG. 12 is a perspective view of a pair of opposing first and second windings 626, 628 when separated from coupled inductor 600, but retaining their relative positions within coupled inductor 600. First windings 626 and second windings 628 are, for example, foil windings having substantially rectangular cross-section with respective thicknesses 630 and 632, as shown. However, in some alternate embodiments, windings 626, 628 have different cross-sectional shapes, such as circular cross-sectional shapes.

Opposing ends of each first winding 626 form respective first solder tabs 634 and second solder tabs 636, and opposing ends of each second winding 628 form respective third solder tabs 638 and fourth solder tabs 640. Although not required, it is anticipated that first windings 626 will typically have the same configurations as second windings 628, to minimize number of different component types required to form coupled inductor 600. However, first windings 626 and second windings 628 have opposing orientations in coupled inductor 600, such each first winding 626 mirrors an opposing respective second winding 628, as seen when looking toward magnetic core 608 cross-sectionally in the height 606 direction. For example, each first winding 626 forms a first U-shaped cross section, and each second winding 628 forms a second U-shaped cross-section, where each second U-shaped cross-section is rotated by about one hundred eighty degrees with respect to each first U-shaped cross-section, when seen looking toward magnetic core 608 in the height 606 direction.

First plate 610 includes a first side outer surface 644, a second side outer surface 646, and a bottom outer surface 648. First side outer surface 644 and second side outer surface 646 oppose each other and are separated from each other in the lengthwise 602 direction. Bottom outer surface 648 is disposed between first side outer surface 644 and second side outer surface 646 in the lengthwise 602 direction. Each first winding 626 wraps around first side outer surface 644 to form first solder tabs 634 and second solder tabs 636 on bottom outer surface 648, and each second winding 628 wraps around second side outer surface 646 to form third solder tabs 638 and fourth solder tabs 640 on bottom outer surface 648. Opposing ends of each first winding 626 are interdigitated with opposing ends of a respective opposing second winding 628 on bottom outer surface 648, such that first and second solder tabs 634, 636 of the first winding are interdigitated with third and fourth solder tabs 638, 640 of the second winding. In other words, for each pair of opposing first and second windings 626, 628, third solder tab 638 is disposed between first solder tab 634 and second solder tab 636, and second solder tab 636 is disposed between third solder tab 638 and fourth solder tab 640, in the widthwise 604 direction. Consequentially, for each pair of opposing first and second windings 626, 628, each solder tab 634, 636, 638, 640 overlaps with each other solder tab, when seen looking cross-sectionally toward magnetic core 608 in the widthwise 604 direction. As discussed below, such solder tab arrangement advantageously facilitates connecting coupled inductor 600 to external circuitry.

The relationship between windings 626, 628 and magnetic core 608 advantageously enables inverse magnetic coupling to be achieved in multi-phase switching power converter applications by coupling either first and fourth solder tabs 634 and 640, or second and third solder tabs 636 and 638, of each pair of opposing first and second windings 626, 628, to respective switching nodes. Inverse magnetic coupling is achieved with either of such configurations because current flowing into either both first and fourth solder tabs 634 and 640, or both second and third solder tabs 636 and 638, of each winding pair results in magnetic flux flowing in the same direction in each coupling tooth 616, 618. For instance, current flowing into each first and fourth solder tab 634 and 640 causes magnetic flux to flow downward in each first and second coupling tooth 616, 618. On the other hand, current flowing into each second and third solder tab 636 and 638 causes magnetic flux to flow upward in each first and second coupling tooth 616, 618.

Figure 13:
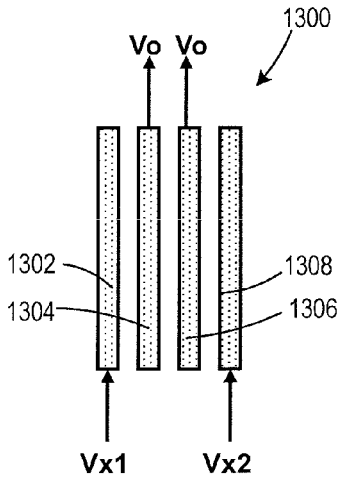
FIG. 13 illustrates one possible printed circuit board footprint for use with the FIG. 6 multi-row coupled inductor, according to an embodiment.
Figure 14:
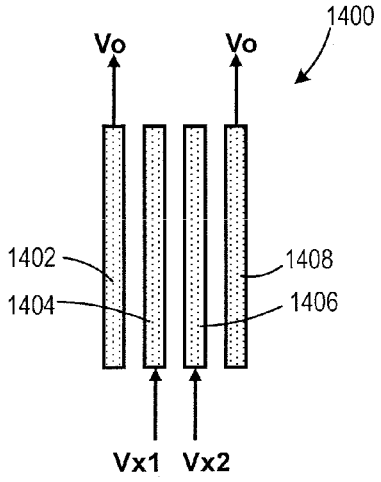
FIG. 14 illustrates another possible printed circuit board footprint for use with the FIG. 6 multi-row coupled inductor, according to an embodiment.

FIGS. 13 and 14 illustrate two possible printed circuit board (PCB) footprints for use with multi-row coupled inductor 600 in a multi-phase buck converter application which achieves inverse magnetic coupling. FIG. 13 illustrates a footprint 1300 including solder pads 1302, 1304, 1306, and 1308 for respectively coupling to solder tabs 634, 636, 638, and 640. Thus, one instance of footprint 1300 would be used with each pair of opposing first and second windings 626, 628. Outer solder pads 1302 and 1308 are electrically coupled to respective buck converter switching nodes $V_x(1)$ and $V_x(2)$, while inner pads 1304 and 1306 are electrically coupled to a common output node $V_o$. Such pin-out of footprint 1300 is possible because the relationship between windings 626, 628 and magnetic core 608 of coupled inductor 600 enables inverse magnetic coupling to be achieved when first and fourth solder tabs 634 and 640 are electrically coupled to respective switching nodes, as discussed above. Use of footprint 1300 may be particularly advantageous when a single integrated circuit is used to drive both switching nodes $V_x(1)$ and $V_x(2)$ of each opposing winding pair, and the switching terminals of the integrated circuit are not close to each other.

FIG. 14 illustrates a footprint 1400 including solder pads 1402, 1404, 1406, and 1408 for respectively coupling to solder tabs 634, 636, 638, and 640. Thus, one instance of footprint 1400 would be used with each pair of opposing first and second windings 626, 628. Inner solder pads 1404 and 1406 are electrically coupled to respective buck converter switching nodes $V_x(1)$ and $V_x(2)$, while outer pads 1402 and 1408 are electrically coupled to a common output node $V_o$. Such pin-out of footprint 1400 is possible because the relationship between windings 626, 628 and magnetic core 608 of coupled inductor 600 enables inverse magnetic coupling to be achieved when second and third solder tabs 636 and 638 are electrically coupled to respective switching nodes, as discussed above. Use of footprint 1400 may be particularly advantageous when a single integrated circuit is used to drive both switching nodes $V_x(1)$ and $V_x(2)$ of each opposing winding pair, and the switching terminals of the integrated circuit are close to each other.

The solder tab configuration of windings 626, 628 also advantageously facilitates connecting the coupled inductor to external circuitry. In particular, the fact that all solder tabs of each opposing winding pair overlap with each other, when seen looking cross-sectionally toward magnetic core 608 in the widthwise 604 direction, facilitates connecting two solder tabs of each pair via a common PCB conductive shape. For instance, consider footprint 1300 of FIG. 13. As can be appreciated from this figure, the solder tab configuration enables solder pads 1304, 1306, which are connected to common output node $V_o$, to be disposed side-by-side, thereby facilitating connecting solder pads 1304, 1306 via a common PCB conductive shape. Use of a common PCB conductive shape, in turn, simplifies PCB layout and potentially allows for greater conductive shape surface area than if separate conductive shapes were connected to each output node $V_o$ solder pad.

As shown in FIG. 9, magnetic core 608 optionally further includes a leakage tooth 650 having a height 652 and disposed between first row 622 and second row 624 in the lengthwise 602 direction. Leakage tooth 650, which is also disposed between first plate 610 and second plate 612 in the height direction 606, provides a magnetic flux path between the first and second plates, thereby providing a path for leakage magnetic flux. Although not required, leakage tooth height 652 is typically smaller than separation distance 620 between first plate 610 and second plate 612, such that leakage tooth 650 is separated from the first plate and/or the second plate by one or more gaps of non-magnetic material, such as air, paper, plastic, and/or adhesive. In some alternate embodiments, however, leakage tooth height 652 equals separation distance 620, and leakage tooth 650 joins first plate 610 and second plate 612.

Leakage tooth 650 could alternatively include two or more separate leakage teeth which collectively provide a path for magnetic flux between first plate 610 and second plate 612. For example, in one alternate embodiment, leakage tooth 650 includes separate first and second leakage teeth originating from first plate 610 and second plate 612, respectively, where the first and second leakage teeth extend towards each other in the height 606 direction.

Leakage inductance associated with windings 626, 628 is inversely proportional to reluctance of the magnetic flux path between first plate 610 and second plate 612. Thus, leakage inductance and associated energy storage can be adjusted during the design of coupled inductor 600 by modifying the configuration of leakage tooth 650. For example, leakage inductance can be increased by decreasing thickness of one or more gaps separating leakage tooth 650 from first and/or second plates 610 and 612 in the height 606 direction, increasing the cross-sectional area of leakage tooth 650 in the lengthwise 602 by widthwise 604 directions, and/or by increasing magnetic permeability of leakage tooth 650. Conversely, leakage inductance can be decreased by increasing gap thickness in the height 606 direction, decreasing leakage tooth cross-sectional area in the lengthwise by widthwise directions, and/or by decreasing magnetic permeability of leakage tooth 650.

Figure 15:
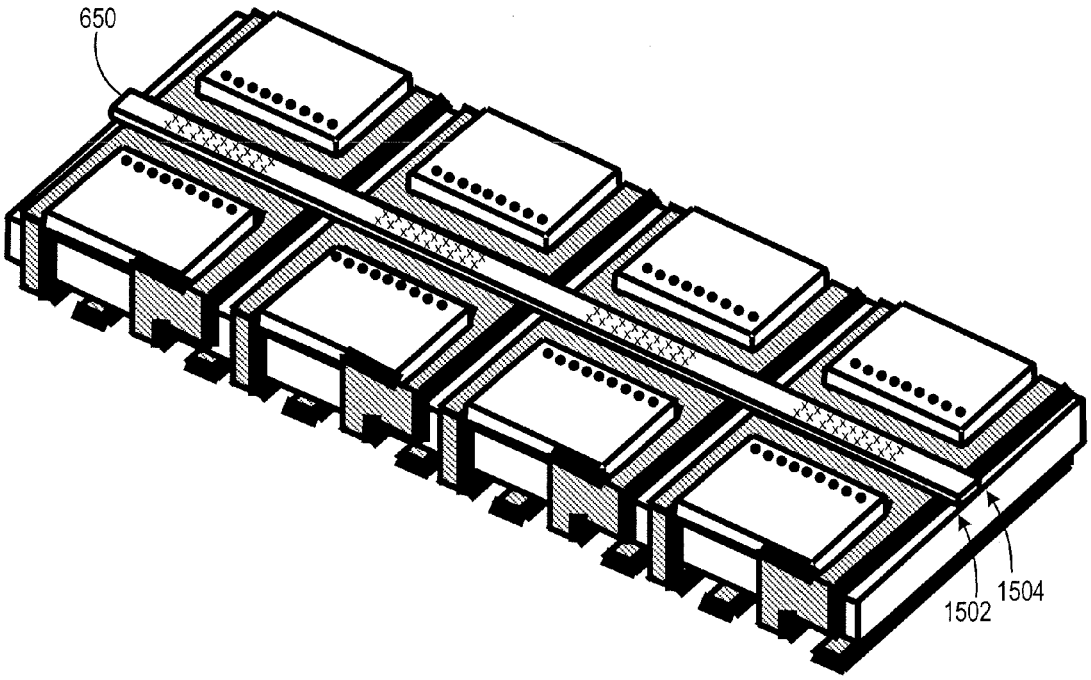
FIG. 15 is a perspective view of the FIG. 6 multi-row coupled inductor with a magnetic plate removed to show an interior of the coupled inductor.

Length 602 by width 604 cross-sectional area of leakage tooth 650 is efficiently used in that both sides of the leakage tooth 650 conduct significant leakage magnetic flux, because leakage tooth 650 is disposed between two winding rows. Consider, for example, FIG. 15, which shows a perspective view of multi-row coupled inductor 600 with second plate 612 removed to show the interior of the coupled inductor. As known in the art of magnetics, magnetic flux takes the path of least reluctance, to minimize inductance and associated energy storage, and the path of least reluctance is typically the shortest path. Thus, leakage magnetic flux associated with first windings 626 will flow through leakage tooth 650 primarily through side 1502, and leakage magnetic flux associated with second windings 628 will flow through leakage tooth 650 primarily through side 1504, to minimize leakage magnetic flux loop length. FIG. 15 illustrates the highest density leakage magnetic flux in magnetic core 608 using dots and the letter "x", assuming current flows around each first coupling tooth 616 and each second coupling tooth 618 in a counterclockwise direction. Each dot represents leakage magnetic flux flowing out of the page, and each letter "x" represents leakage magnetic flux flowing into the page. Significant leakage magnetic flux flows through both sides 1502, 1504 of leakage tooth 650, as illustrated in FIG. 15, and leakage tooth 650 cross-sectional area is therefore efficiently used.

Figure 1:
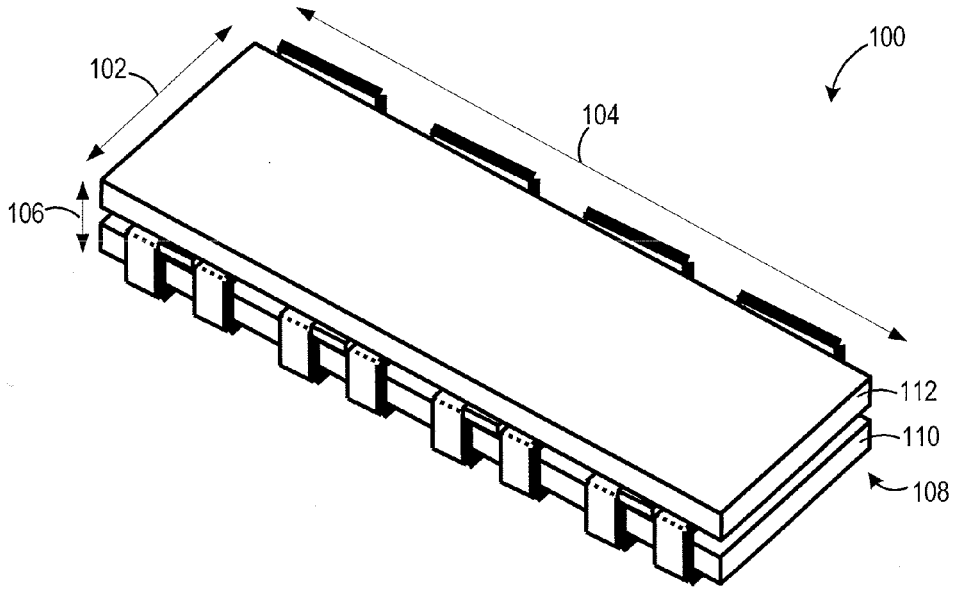
(PRIOR ART) FIG. 1
FIG. 1 is a perspective view of a prior art coupled inductor.
Figure 2:
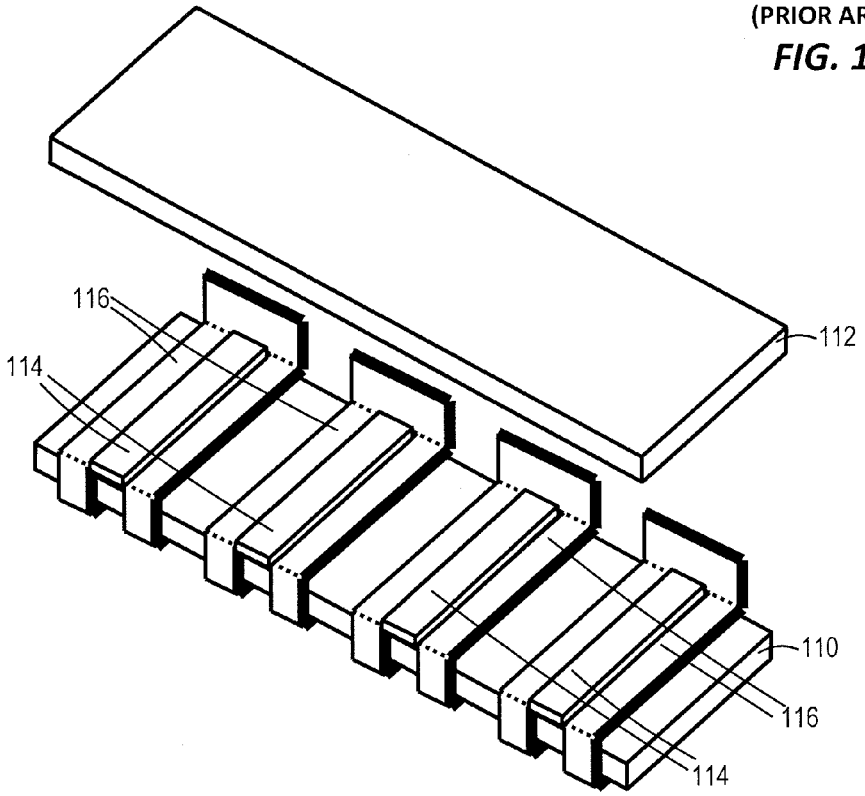
(PRIOR ART) FIG. 2
FIG. 2 is an exploded perspective view of the FIG. 1 coupled inductor showing a magnetic core plate separated from the remainder of the coupled inductor.
Figure 3:
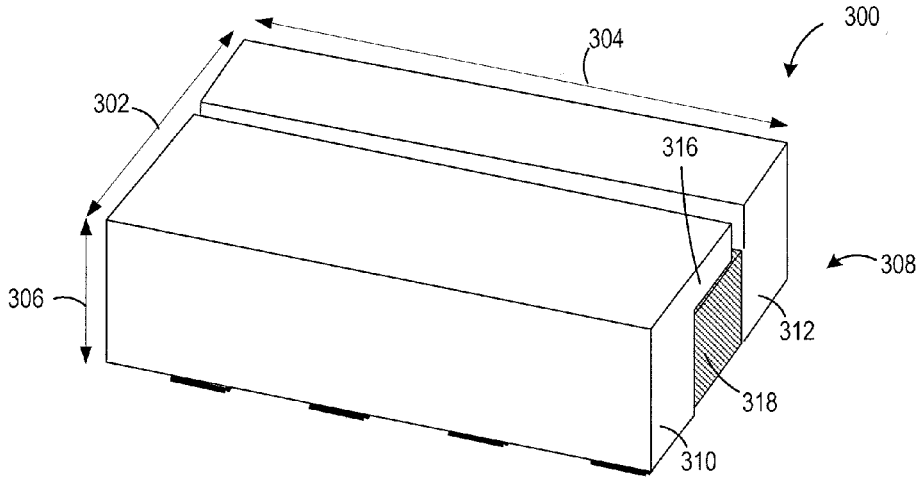
(PRIOR ART) FIG. 3
FIG. 3 is a perspective view of another prior art coupled inductor.
Figure 4:
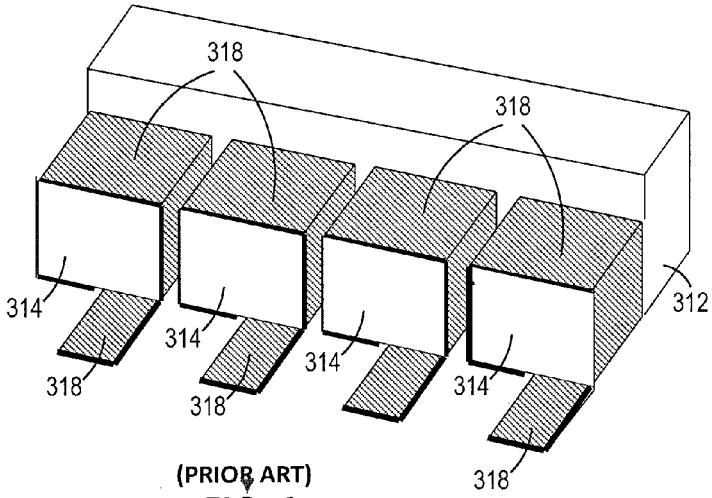
(PRIOR ART) FIG. 4
FIG. 4 is a perspective view of the FIG. 3 coupled inductor with a first rail and a top magnetic element removed from the coupled inductor.
Figure 5:
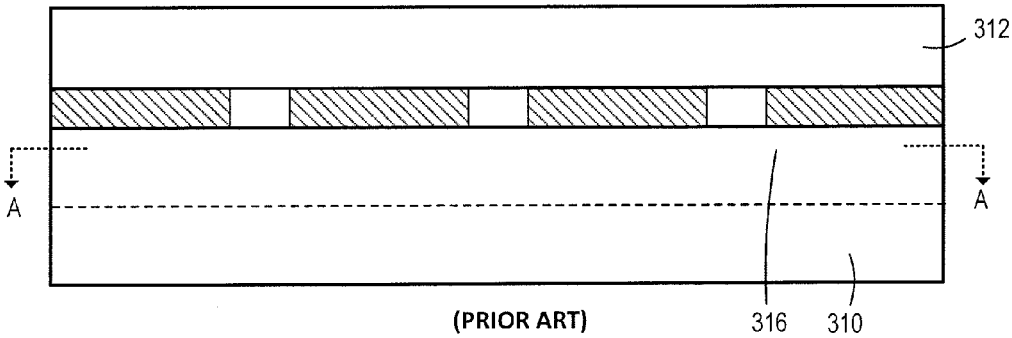
(PRIOR ART) FIG. 5
FIG. 5 is a top plan view of the FIG. 3 coupled inductor.
Figure 16:
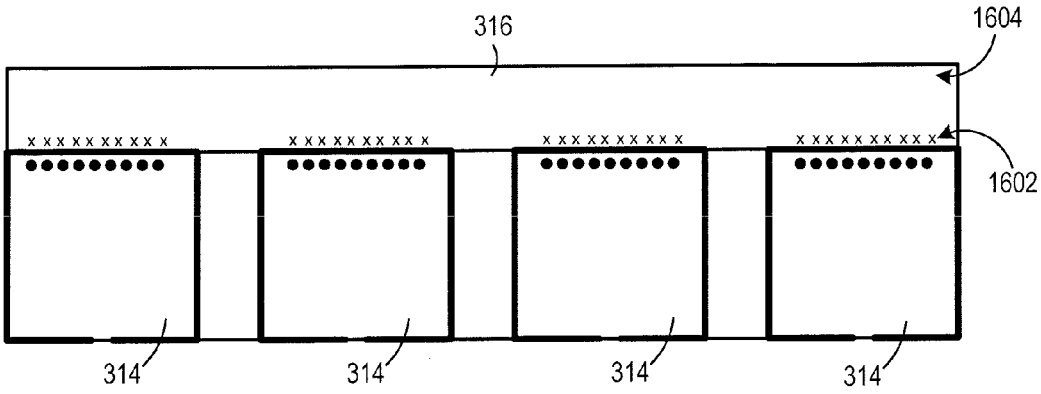
(PRIOR ART) FIG. 16
FIG. 16 is a cross-sectional view of the FIG. 3 prior art coupled inductor.

In some conventional coupled inductors, in contrast, leakage magnetic element cross-sectional area is not used as efficiently as in multi-row couple inductor 600. For example, consider FIG. 16, which is a cross-sectional view of prior art coupled inductor 300 taken along line A-A of FIG. 5. Each dot represents leakage magnetic flux flowing out of the page, and each letter "x" represents leakage magnetic flux flowing into the page. Leakage magnetic flux primarily flows through side 1602 of top magnetic element 316 to minimize the leakage magnetic flux loop length, as illustrated in FIG. 16, such that opposing side 1604 of top magnetic element 316 is significantly unused. Thus, the cross-sectional area of top magnetic element 316 is not used as efficiently as the cross-sectional area of leakage tooth 650 of coupled inductor 600.

Each first winding 626 and each second winding 628 has a "horizontal" configuration in that its respective thicknesses 630 or 632 is parallel to the height 606 direction, along portions of the winding that are wound around a respective coupling tooth 616 or 618. For example, consider again FIG. 10, which shows one instance of first winding 626, as discussed above. Portions 1002, 1004, and 1006 of first winding 626 are wound around a respective first coupling tooth 616, when the winding is installed in coupled inductor 600. Thickness 630 of first winding 626 is parallel to the height 606 direction along each of portions 1002, 1004, 1006, due to the winding having a horizontal configuration. Horizontal winding configuration advantageously helps minimize coupled inductor height 606 when using foil conductors.

However, Applicant has discovered it may be advantageous in some applications for the windings to have a "vertical" configuration, instead of a horizontal configuration, because the vertical configuration allows for larger cross-sectional area of coupling teeth 616 and 618 at a given magnetic core 608 length 602 and width 604. Larger coupling teeth cross-sectional area, in turn, reduces magnetic flux density at a given total magnetic flux, thereby promoting low magnetic core losses. Accordingly, in some alternate embodiments of coupled inductor 600, first windings 626 and second windings 628 are replaced with windings have a vertical configuration, which is characterized by foil winding thickness being orthogonal to the height direction 606, along winding portions wound around coupling teeth.

Figure 17:
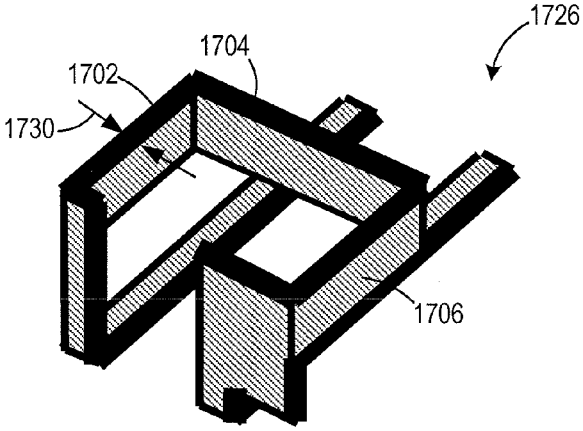
FIG. 17 is a perspective view of a first winding having a vertical configuration.
Figure 18:
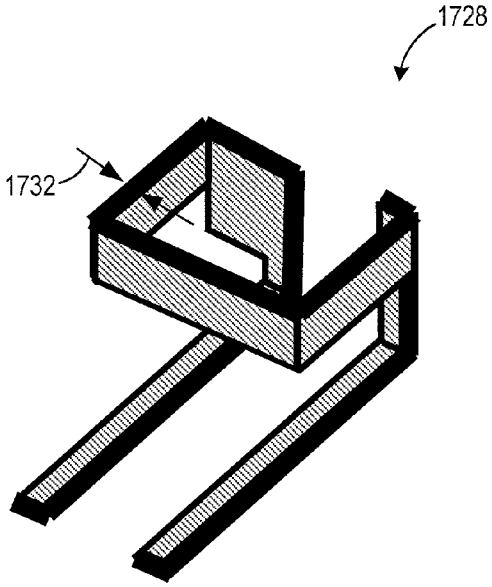
FIG. 18 is a perspective view of a second winding having a vertical configuration, according to an embodiment.

For example, in some alternate embodiments, each first winding 626 is replaced with a first winding 1726 instance, shown in FIG. 17, and each second winding 628 is replaced with a second winding 1728 instance, shown in FIG. 18. Both first winding 1726 and second winding 1728 have a vertical configuration. Specifically, a thickness 1730 of first winding 1726 is orthogonal to the height 606 direction along winding portions wound around a respective first coupling tooth, and a thickness 1732 of second winding 1728 is orthogonal to the height direction 606 along winding portions wound around a respective second coupling tooth. For example, portions 1702, 1704, and 1706 of first winding 1726 are wound around a respective first coupling tooth, when the winding is installed in a coupled inductor. Thickness 1730 of first winding 1726 is therefore orthogonal to the height 606 direction along each of portions 1702, 1704, 1706, due to winding 1726 having a vertical configuration.

Figure 19:
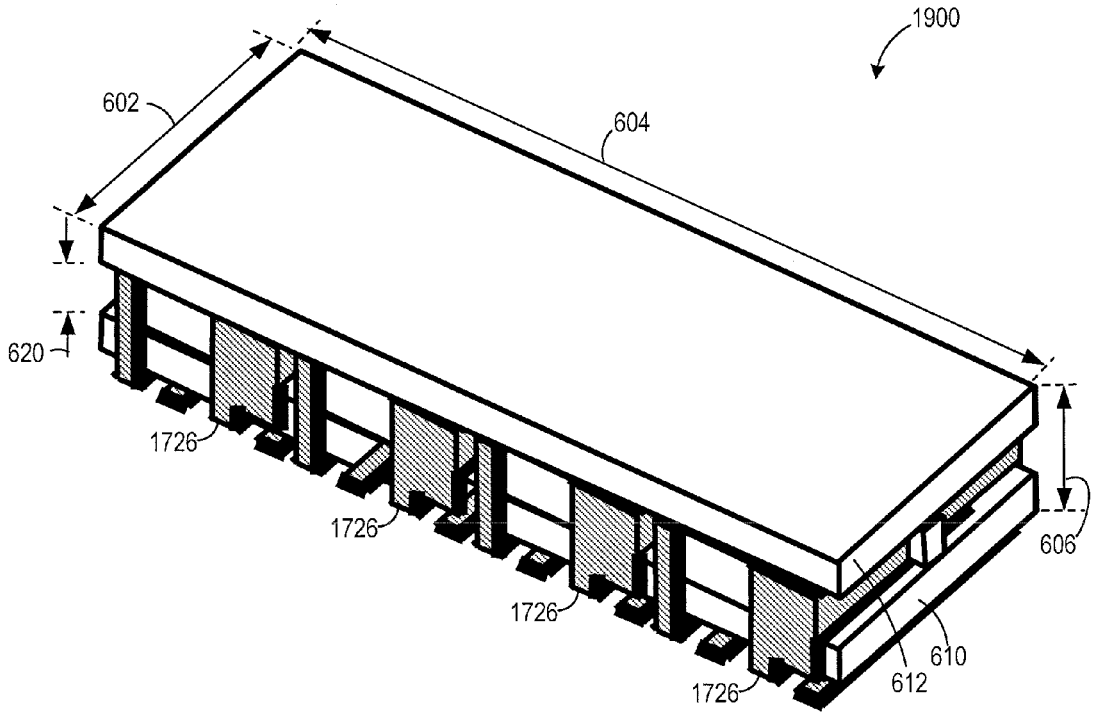
FIG. 19 is a perspective view of a multi-row coupled inductor similar to that of FIG. 6, but with horizontal configuration windings replaced with vertical configuration windings, according to an embodiment.
Figure 20:
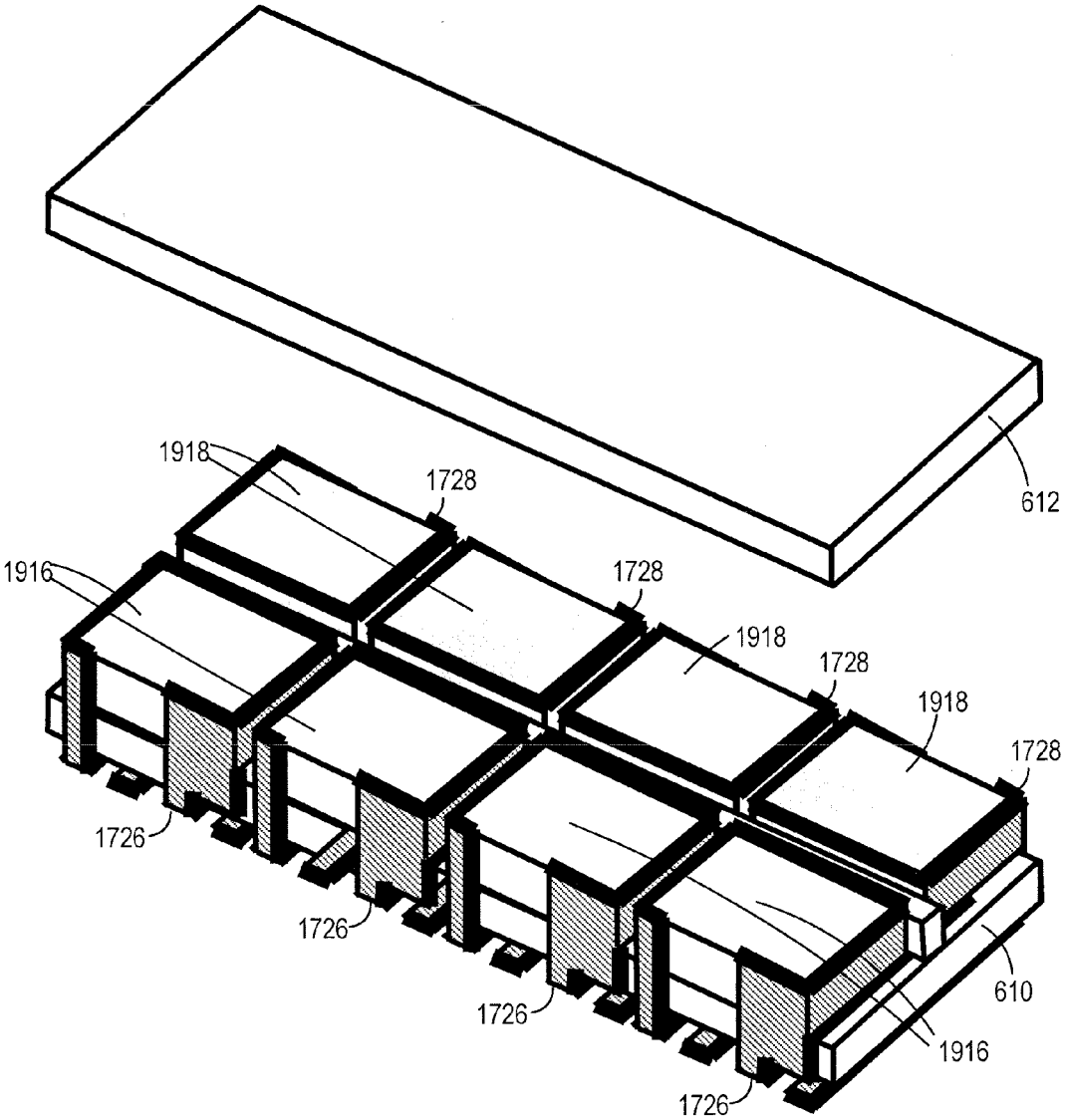
FIG. 20 is an exploded perspective view of the FIG. 19 multi-row coupled inductor showing a second magnetic plate separated from the remainder of the inductor.

FIG. 19 is a perspective view of a coupled inductor 1900, which is similar to coupled inductor 600 of FIG. 6, but with horizontal configuration first windings 626 and second windings 628 replaced with vertical configuration first windings 1726 and second windings 1728, respectively. First coupling teeth 616 and second coupling teeth 618 are also replaced with first coupling teeth 1916 and second coupling teeth 1918, respectively, to provide sufficient clearance for windings 1726, 1728 in the height 606 direction. Coupling teeth 1916, 1918 are taller (in the height 606 direction) than coupling teeth 616, 618, so that substituting coupling teeth 1916, 1918 for coupling teeth 616, 618 increases separation distance 620 between first plate 610 and second plate 612. FIG. 20 is an exploded perspective view of coupled inductor 1900 showing second plate 612 separated from the remainder of the coupled inductor.

Figure 21:
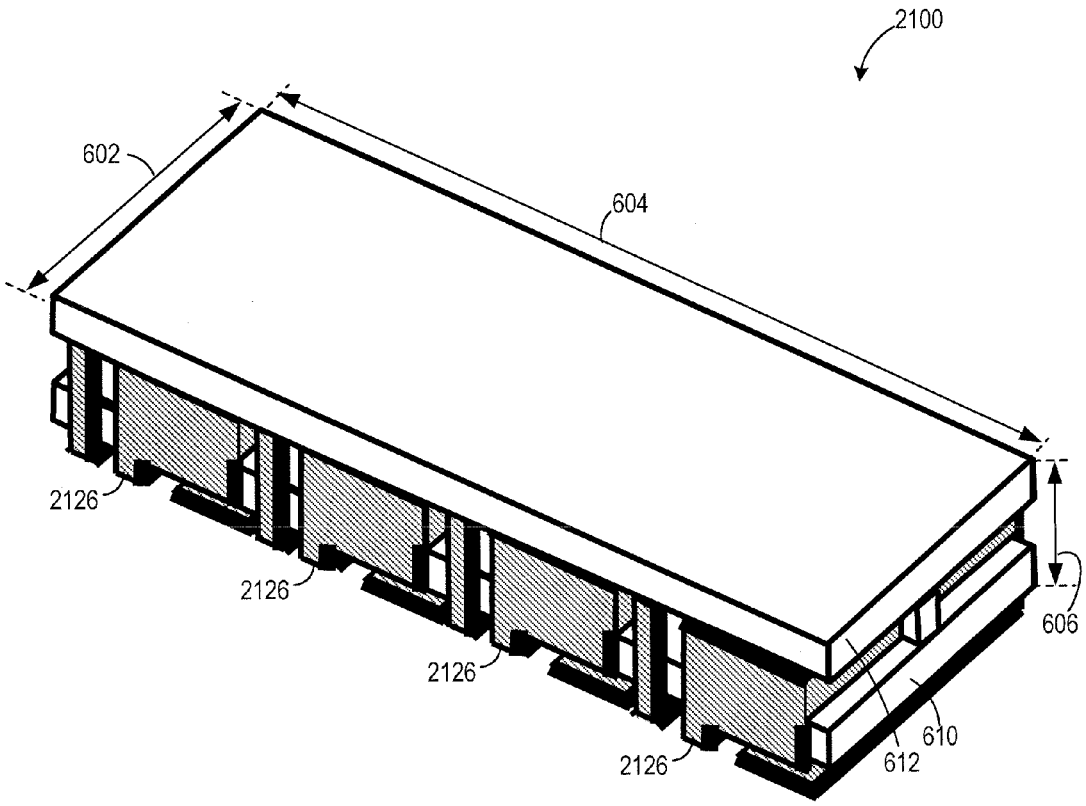
FIG. 21 is a perspective view of a multi-row coupled inductor similar to that of FIG. 19, but with different windings, according to an embodiment.
Figure 22:
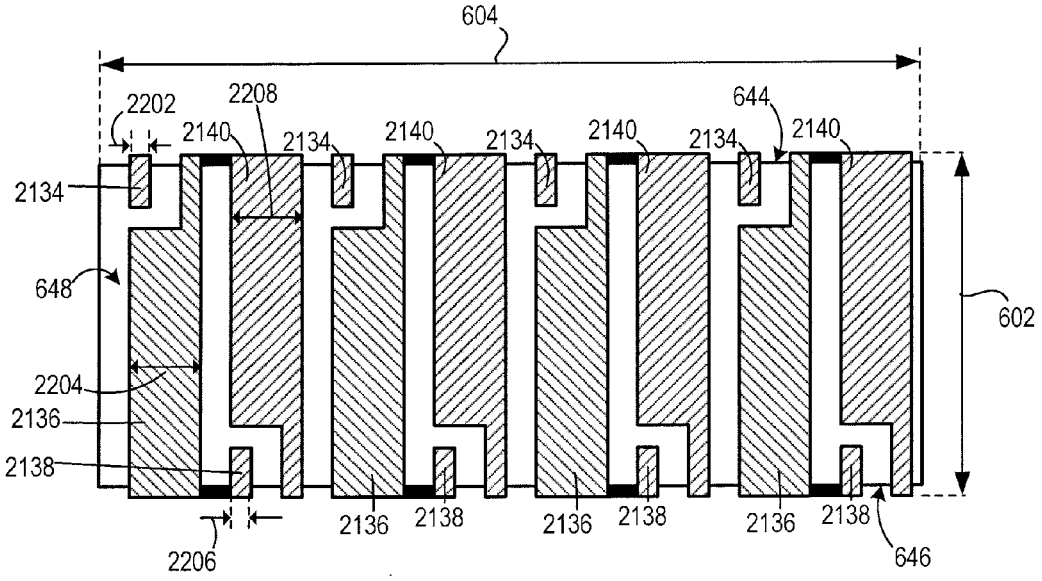
FIG. 22 is a bottom plan view of the multi-row coupled inductor of FIG. 21.
Figure 23:
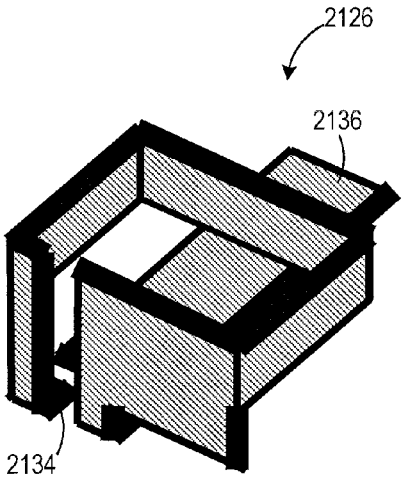
FIG. 23 is a perspective view of one instance of a first winding of the FIG. 21 multi-row coupled inductor.
Figure 24:
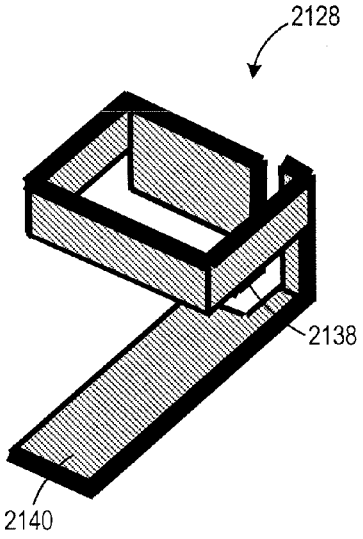
FIG. 24 is a perspective view of one instance of a second winding of the FIG. 21 multi-row coupled inductor.

FIG. 21 is a perspective view, and FIG. 22 is a bottom plan view, of a multi-row coupled inductor 2100. Multi-row coupled inductor 2100 is similar to multi-row coupled inductor 1900 of FIG. 19, but with first windings 1726 and second windings 1728 replaced with first windings 2126 and second windings 2128, respectively. FIG. 23 shows a perspective view of one first winding 2126 instance, and FIG. 24 shows a perspective view of one second winding 2128 instance. Opposing ends of each first winding 2126 form respective first solder tabs 2134 and second solder tabs 2136, and opposing ends of each second winding 2128 form respective solder third tabs 2138 and fourth solder tabs 2140. Solder tabs 2134, 2136, 2138, and 2140 have respective widths 2202, 2204, 2206, and 2208. (See FIG. 22).

Figure 25:
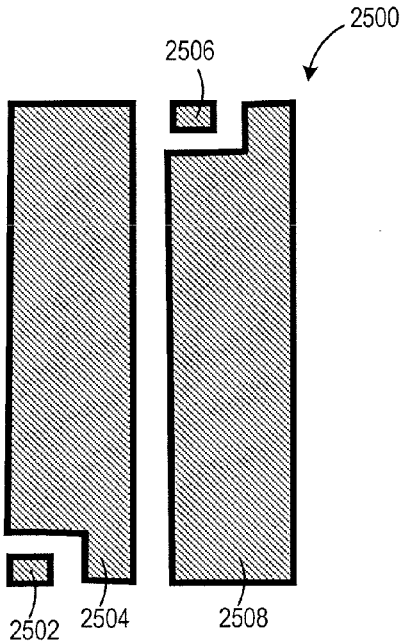
FIG. 25 illustrates one possible printed circuit board footprint for use with the FIG. 21 multi-row coupled inductor, according to an embodiment.
Figure 26:
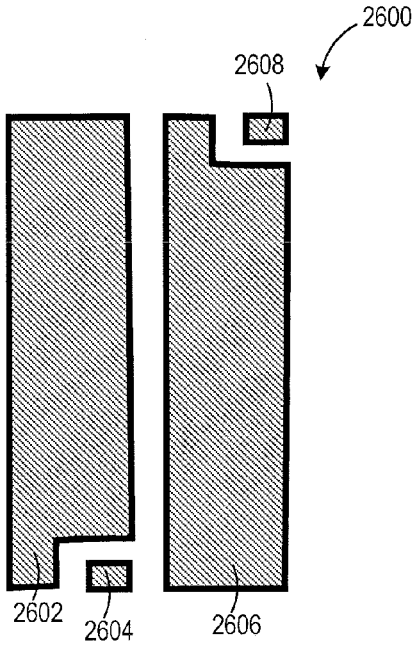
FIG. 26 illustrates another possible printed circuit board footprint for use with the FIG. 21 multi-row coupled inductor, according to an embodiment.

It is anticipated that in many applications, solder tabs 2136 and 2140 will carry current along most or all of coupled inductor 2100's length 602, while solder tabs 2134 and 2138 will carry current much shorter distances. For example, FIGS. 25 and 26 show PCB footprints 2500 and 2600, respectively, which are examples of possible PCB footprints that may be used with multi-row coupled inductor 2100 in a multi-phase buck converter application. Pads 2502, 2504, 2506, and 2508 of footprint 2500 couple to solder tabs 2134, 2136, 2138, and 2140, respectively. Pads 2602, 2604, 2606, and 2608 of footprint 2600 couple to solder tabs 2134, 2136, 2138, and 2140, respectively. As evident from FIGS. 25 and 26, solder tabs 2136 and 2140 will carry current significantly further than solder tabs 2134 and 2138 in footprints 2500 and 2600.

Accordingly, solder tab widths 2204 and 2208 are significantly greater than solder tab widths 2202 and 2206, so that solder tabs expected to carry current relatively long distances are wider than those expected to carry current short distances. Such disparity in solder tab widths helps optimize coupled inductor 2100's footprint in that the majority of solder tab surface area is devoted to solder tabs expected to carry current significant distance.

Figure 27:
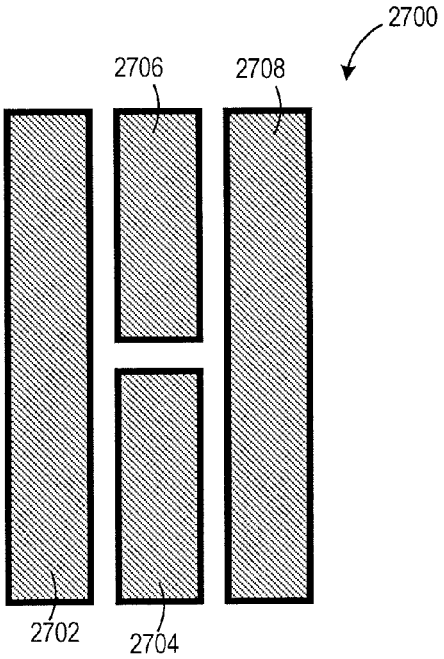
FIG. 27 illustrates a printed circuit board footprint which complements the solder tabs of certain alternate embodiments of the multi-row coupled inductors, according to an embodiment.

First and second windings 626, 628 could be modified to have a solder tabs similar to those of first and second windings 2126, 2128. Additionally, in some alternate embodiment of the multi-row coupled inductors discussed above, the first and second windings are modified to have solder tabs complementing PCB footprint 2700 of FIG. 27. Footprint 2700 includes solder pads 2702, 2704, 2706, and 2708. Solder pads 2702 and 2704 couple to first winding opposing ends, and solder pads 2706 and 2708 couple second winding opposing ends. In buck converter applications, solder pads 2704 and 2706 would each be electrically coupled to a common output node, and there would be a common path for output node current from one side of the coupled inductor to the other.

The multi-row coupled inductor discussed above can be considered horizontal multi-row coupled inductors because the winding rows are separated in the lengthwise direction. Such configuration advantageously promotes low coupled inductor height. However, in some applications, it is desirable to minimize component footprint at the expense of component height. Accordingly, Applicant has also developed vertical multi-row coupled inductors including windings rows separated in the height direction, to minimize coupled inductor footprint.

Figure 28:
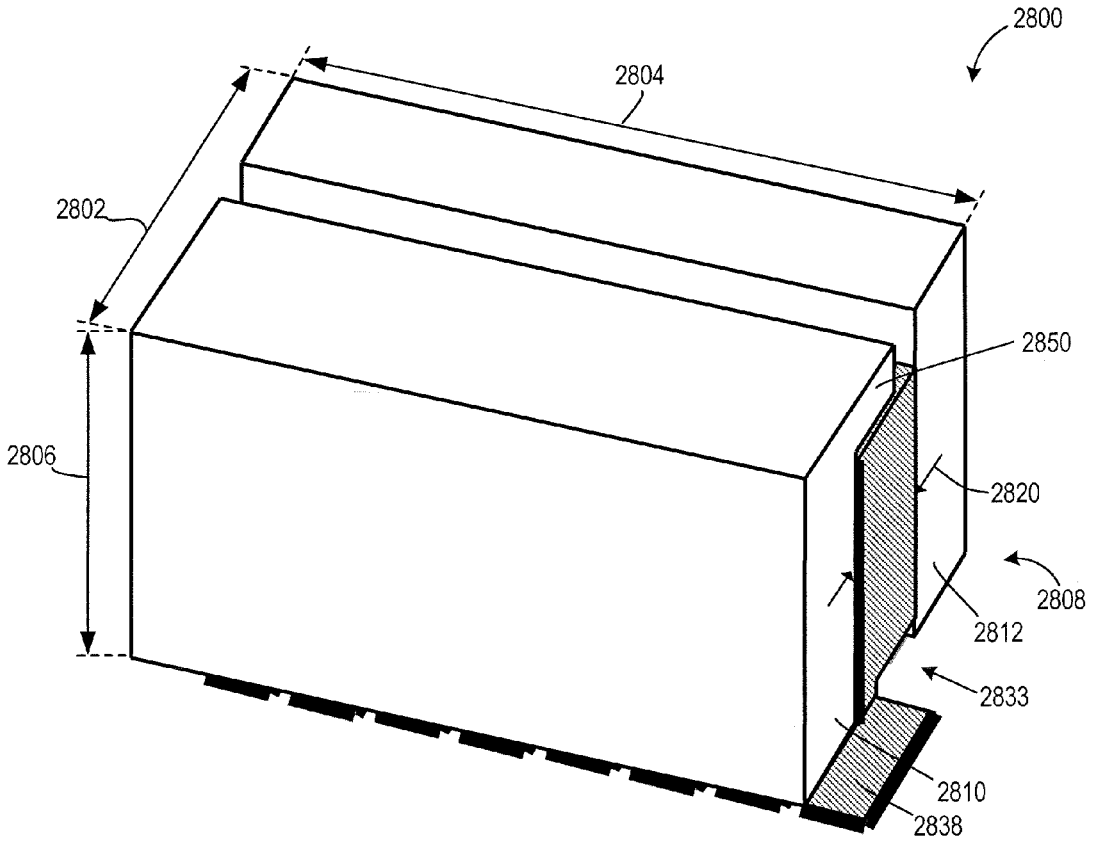
FIG. 28 is a perspective view of a vertical multi-row coupled inductor, accord to an embodiment.
Figure 29:
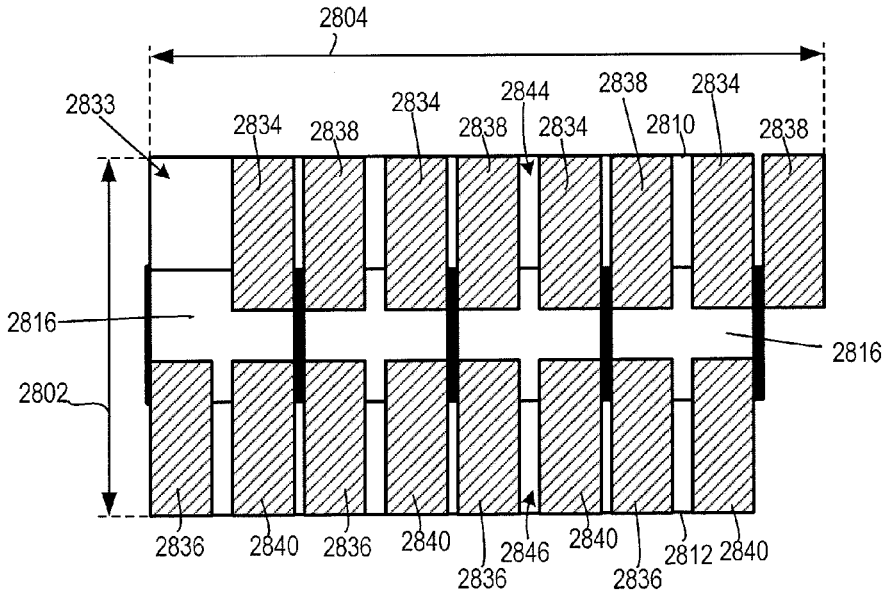
FIG. 29 is a bottom plan view.
Figure 30:
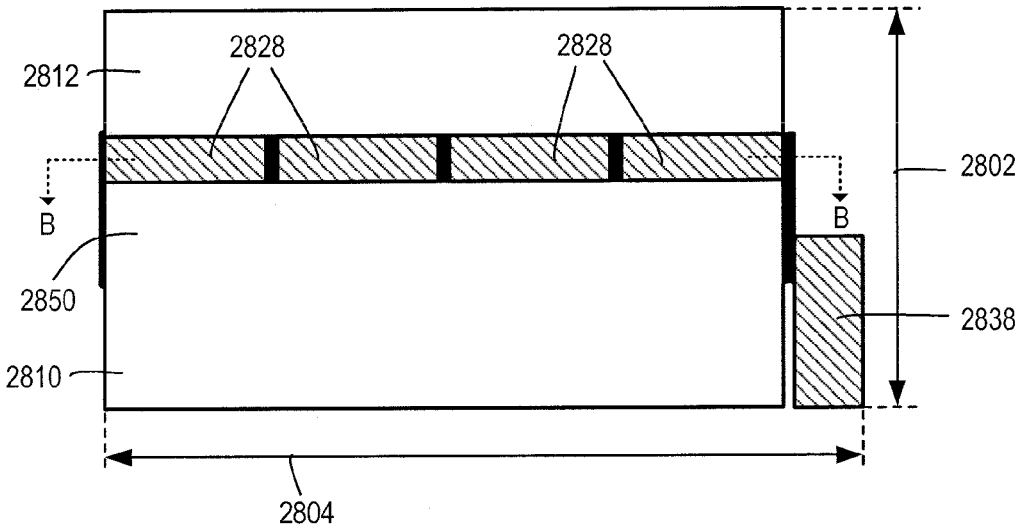
FIG. 30 is a top plan view, of the multi-row coupled inductor of FIG. 28.
Figure 31:
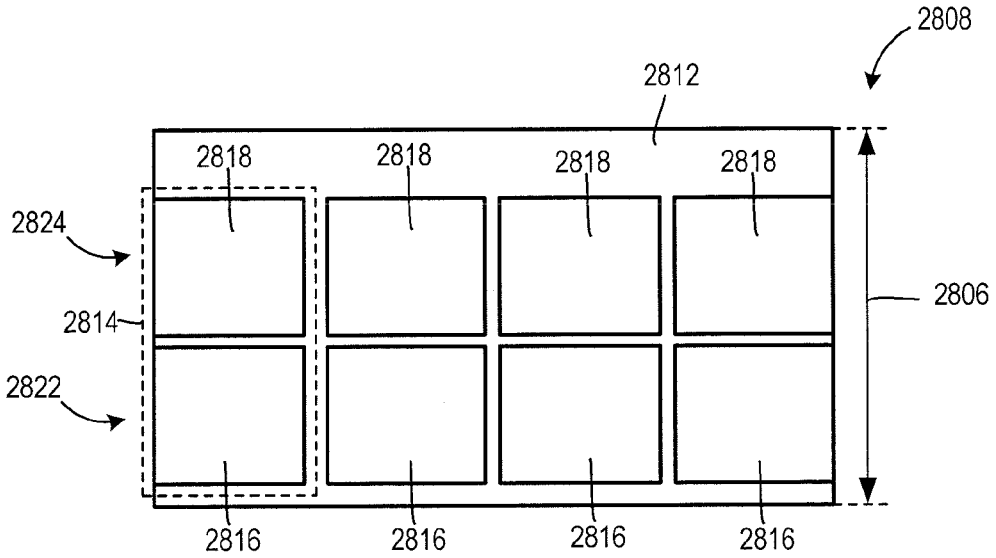
FIG. 31 is a cross-sectional view of the magnetic core of the FIG. 28 multi-row coupled inductor taken along line B-B of FIG. 30.
Figure 32:
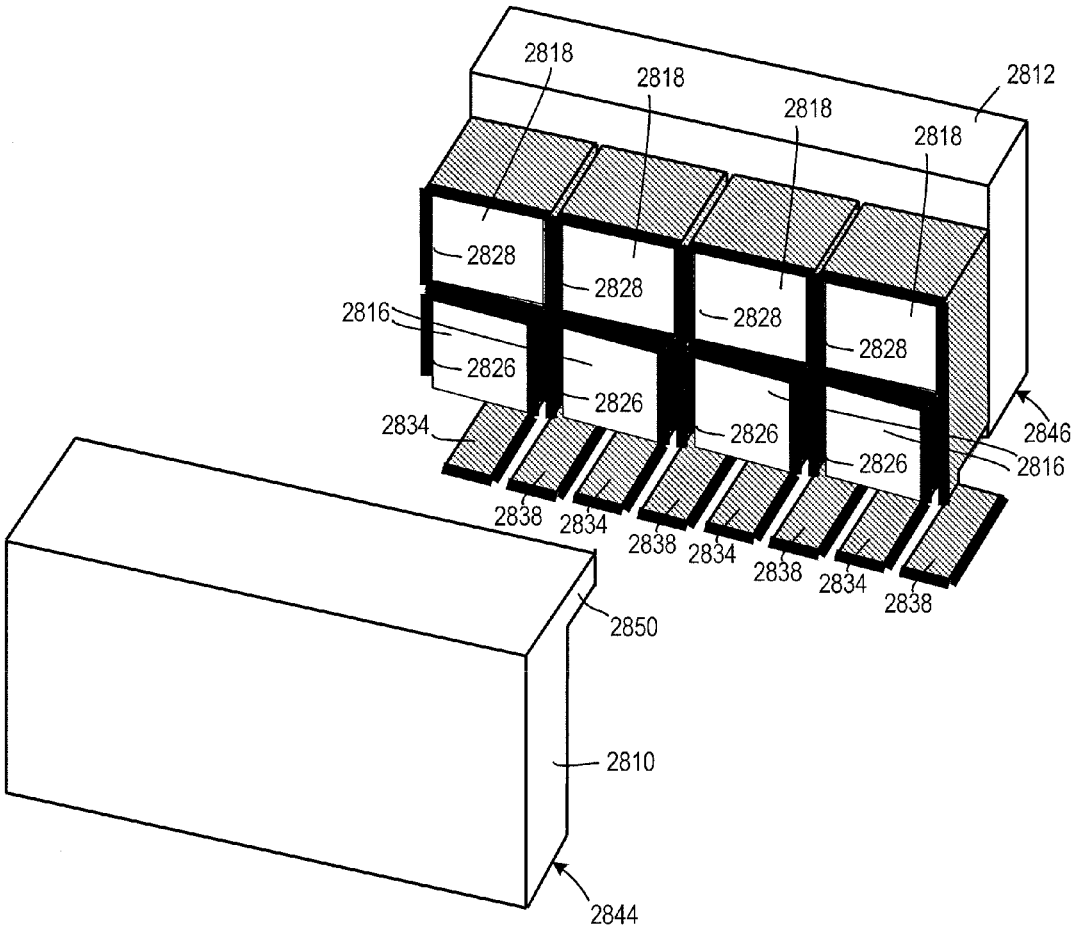
FIG. 32 is an exploded perspective view of the FIG. 28 multi-row coupled inductor showing a first magnetic plate and a leakage tooth separated from the remainder of the coupled inductor.

For example, FIG. 28 is a perspective view, FIG. 29 is a bottom plan view, and FIG. 30 is a top plan view of a vertical multi-row coupled inductor 2800 having a length 2802, a width 2804, and a height 2806 which are orthogonal to each other. Coupled inductor 2800 includes a magnetic core 2808 including a first plate 2810, a second plate 2812, at least one pair 2814 of coupling teeth, and an optional leakage tooth 2850. FIG. 31 is a cross-sectional view of magnetic core 2808 taken along line B-B of FIG. 30, and FIG. 32 is an exploded perspective view of coupled inductor 2800 showing first plate 2810 and leakage tooth 2850 separated from the remainder of the coupled inductor.

Each pair 2814 of coupling teeth includes a first coupling tooth 2816 and a second coupling tooth 2818 separated from and opposing each other in the height 2806 direction. (See FIG. 31). Only one pair 2814 of the four pairs of coupling teeth is labeled in FIG. 31 to promote illustrative clarity. Each first coupling tooth 2816 and each second coupling tooth 2818 are disposed between first plate 2810 and second plate 2812 in the lengthwise 2802 direction, such that each first coupling tooth 2816 and each second coupling tooth 2818 separate first plate 2810 from second plate 2812 by a lengthwise separation distance 2820. Pairs 2814 of coupling teeth are separated from each other in the widthwise 2804 direction, such that all first coupling teeth 2816 are disposed in a first row 2822 in the widthwise 2804 direction, and all second coupling teeth 2818 are disposed in a second row 2824 in the widthwise 2804 direction. Although coupled inductor 2800 is shown as including four pairs 2814 of coupling teeth, the number of pairs 2814 could be varied without departing from the scope hereof. For example, some alternate embodiments include only a single pair 2814 of coupling teeth, as discussed below.

Figure 33:
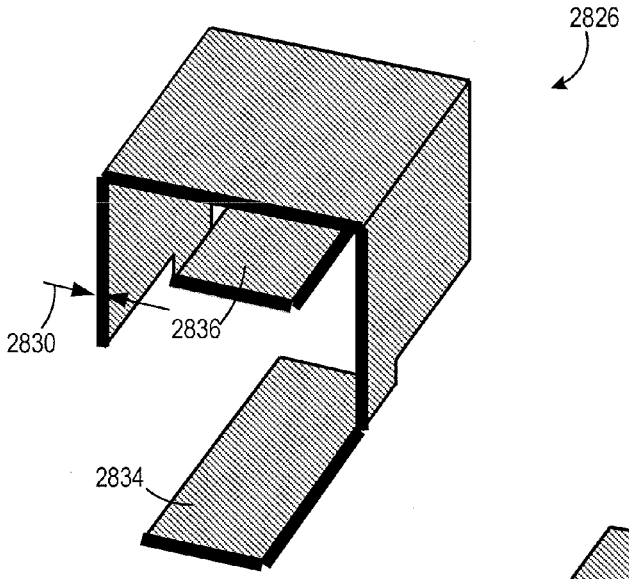
FIG. 33 is a perspective view of one instance of a first winding of the FIG. 28 multi-row coupled inductor.
Figure 34:
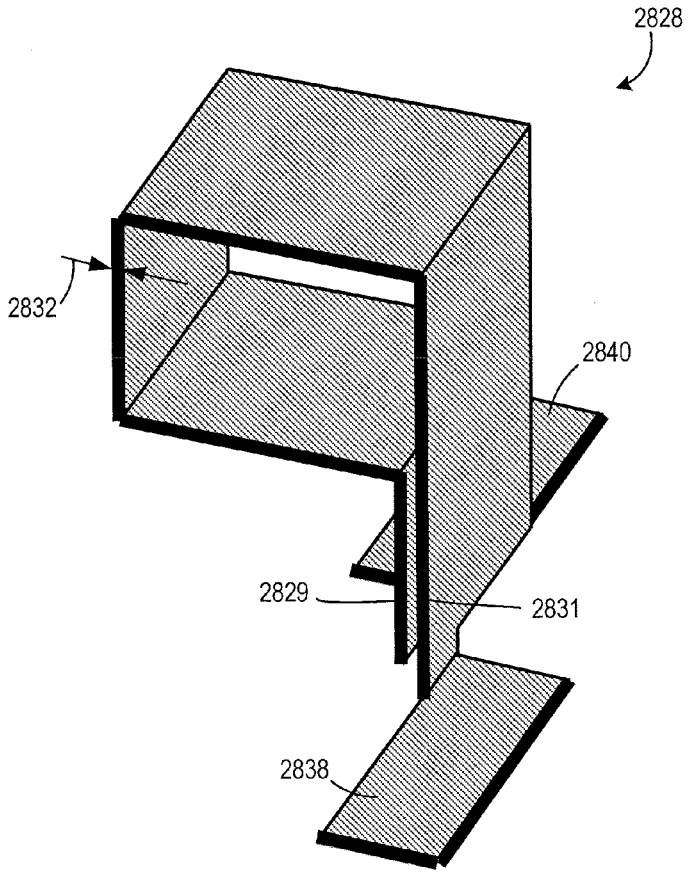
FIG. 34 is a perspective view of one instance of a second winding of the FIG. 28 coupled inductor.
Figure 35:
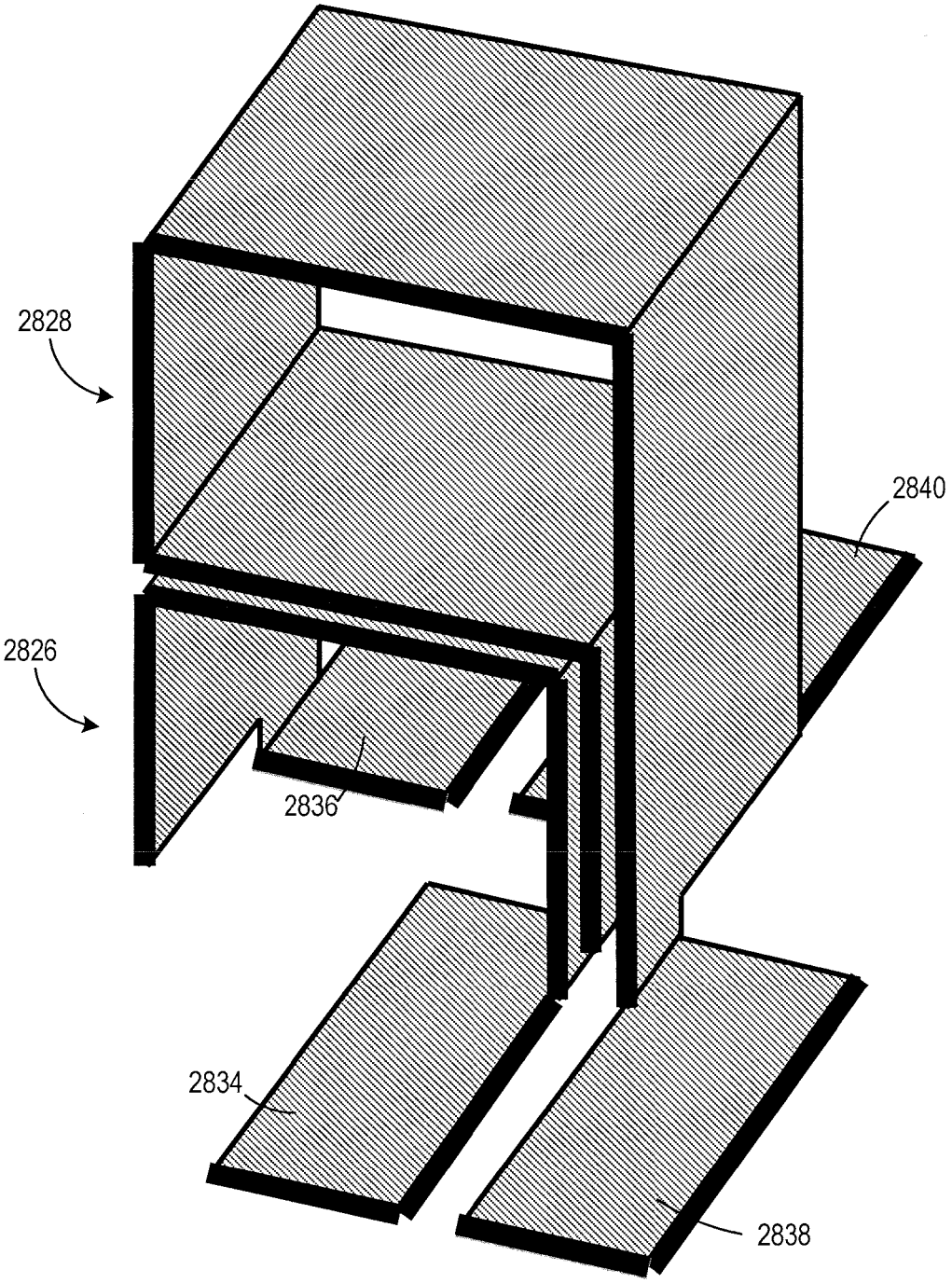
FIG. 35 is a perspective view of a pair of opposing windings of the FIG. 28 multi-row coupled inductor when separated from the coupled inductor, but retaining their relative positions within the coupled inductor.

A respective first winding 2826 is wound around each first coupling tooth 2816, and a respective second winding 2828 is wound around each second coupling tooth 2818, thereby forming two winding rows separated from each other in the height 2806 direction. FIG. 33 is a perspective view of one first winding 2826 instance, and FIG. 34 is a perspective view of one second winding 2828 instance. FIG. 35 is a perspective view of a pair of opposing first and second windings 2826, 2828 when separated from coupled inductor 2800, but retaining their relative positions within coupled inductor 2800. Each second winding 2828 includes two risers 2829, 2831 extending in the height 2806 direction and elevating the second winding above a respective first winding 2826 in the height 2806 direction. First windings 2826 and second windings 2828 are, for example, foil windings having substantially rectangular cross-section with respective thicknesses 2830 and 2832, as shown. First and second windings 2826 and 2828 are, for example, wound around their respective coupling teeth such that foil winding thickness is orthogonal to the lengthwise direction 2802, along winding portions wound around coupling teeth. Such configuration helps maximize portions of magnetic core 2808 encompassed by windings. In some alternate embodiments, though, windings 2826, 2828 have non-rectangular cross-sectional shapes, such as circular cross-sectional shapes.

Opposing ends of each first winding 2826 and each second winding 2828 terminate on a common side 2833 of magnetic core 2808. Opposing ends of each first winding 2826 form respective first solder tabs 2834 and second solder tabs 2836, and opposing ends of each second winding 2828 form respective third solder tabs 2838 and fourth solder tabs 2840. First plate 2810 includes a first bottom outer surface 2844 in the lengthwise 2802 by widthwise 2804 directions, and second plate 2812 includes a second bottom outer surface 2846 in the lengthwise 2802 by widthwise 2804 directions. Each first solder tab 2834 is at least partially disposed on first bottom outer surface 2844, and each second solder tab 2836 and fourth solder tab 2840 are at least partially disposed on second bottom outer surface 2846. Additionally, all but one end third solder tab 2838 is at least partially disposed on first bottom outer surface 2844. Accordingly, each first and third solder tab 2834 and 2838 overlaps with each other first and third solder tab 2834 and 2838, and each second and fourth solder tab 2836 and 2840 overlaps with each other second and fourth solder tab 2836 and 2840, when seen looking toward magnetic core 2808 cross-sectionally in the widthwise 2804 direction. In some embodiments, each of solder tabs 2834, 2836, 2838, and 2840 is substantially disposed in a common plane in the lengthwise 2802 by widthwise 2804 directions, thereby enabling multi-row coupled inductor 2800 to be surface mount soldered to a substantially planar substrate, such as a PCB.

The relationship between windings 2826, 2828 and magnetic core 2808 advantageously enables inverse magnetic coupling to be achieved in multi-phase switching power converter applications by coupling either first and third solder tabs 2834 and 2838 terminating at first plate 2810, or second and fourth solder tabs 2836 and 2840 terminating at second plate 2812, to respective switching nodes. Such feature facilitates placing all switching stages on a common side of multi-row coupled inductor 2800, i.e., proximate to first plate 2810 or second plate 2812, thereby promoting layout simplicity in a switching power converter incorporating the multi-row coupled inductor. Inverse magnetic coupling is achieved with either of such configurations because current flowing into either first and third solder tabs 2834 and 2838, or second and fourth solder tabs 2836 and 2840, of each winding pair results in magnetic flux flowing in the same direction in each coupling tooth 2816, 2818. For instance, current flowing into each second and third solder tab 2834 and 2838 causes magnetic flux to flow from second plate 2812 to first plate 2810 through each first and second coupling tooth 2816, 2818. On the other hand, current flowing into each second and fourth solder tab 2836 and 2840 causes magnetic flux to flow from first plate 2810 to second plate 2812 through each first and second coupling tooth 2816, 2818.

Optional leakage tooth 2850 is disposed over row 2822 and second row 2824 in the height 2806 direction. Leakage tooth 2850, which is also disposed between first plate 2810 and second plate 2812 in the lengthwise 2802 direction, provides a path for magnetic flux between the first and second plates, thereby providing a path for leakage magnetic flux. Although not required, leakage tooth 2850 typically does not span the entire separation distance 2820 between first plate 2810 and second plate 2812, such that leakage tooth 2850 is separated from the first plate and/or the second plate by one or more gaps of non-magnetic material, such as air, paper, plastic, and/or adhesive. In some alternate embodiments, however, leakage tooth 2850 spans the entire separation distance 2820, and leakage tooth 2850 joins first plate 2810 and second plate 2812. Leakage tooth 2850 could alternatively include two or more separate leakage teeth which collectively provide a path for magnetic flux between first plate 2810 and second plate 2812. For example, in one alternate embodiment, leakage tooth 2850 includes separate first and second leakage teeth originating from first plate 2810 and second plate 2812, respectively, where the first and second leakage teeth extending towards each other in the length 2802 direction.

Leakage inductance associated with windings 2826, 2828 is inversely proportional to reluctance of the magnetic flux path between first plate 2810 and second plate 2812. Thus, leakage inductance can be adjusted during the design of coupled inductor 2800 by modifying the configuration of leakage tooth 2850. For example, leakage inductance can be increased by decreasing thickness of one or more gaps separating leakage tooth 2850 from first and/or second plates 2810 and 2812 in the lengthwise 2802 direction, increasing the cross-sectional area of leakage tooth 2850 in the widthwise 2804 by height 2806 directions, and/or by increasing magnetic permeability of leakage tooth 2850. Conversely, leakage inductance can be decreased by increasing gap thickness in the lengthwise 2806 direction, decreasing leakage tooth cross-sectional area in the widthwise by height directions, and/or by decreasing magnetic permeability of leakage tooth 2850.

Figure 36:
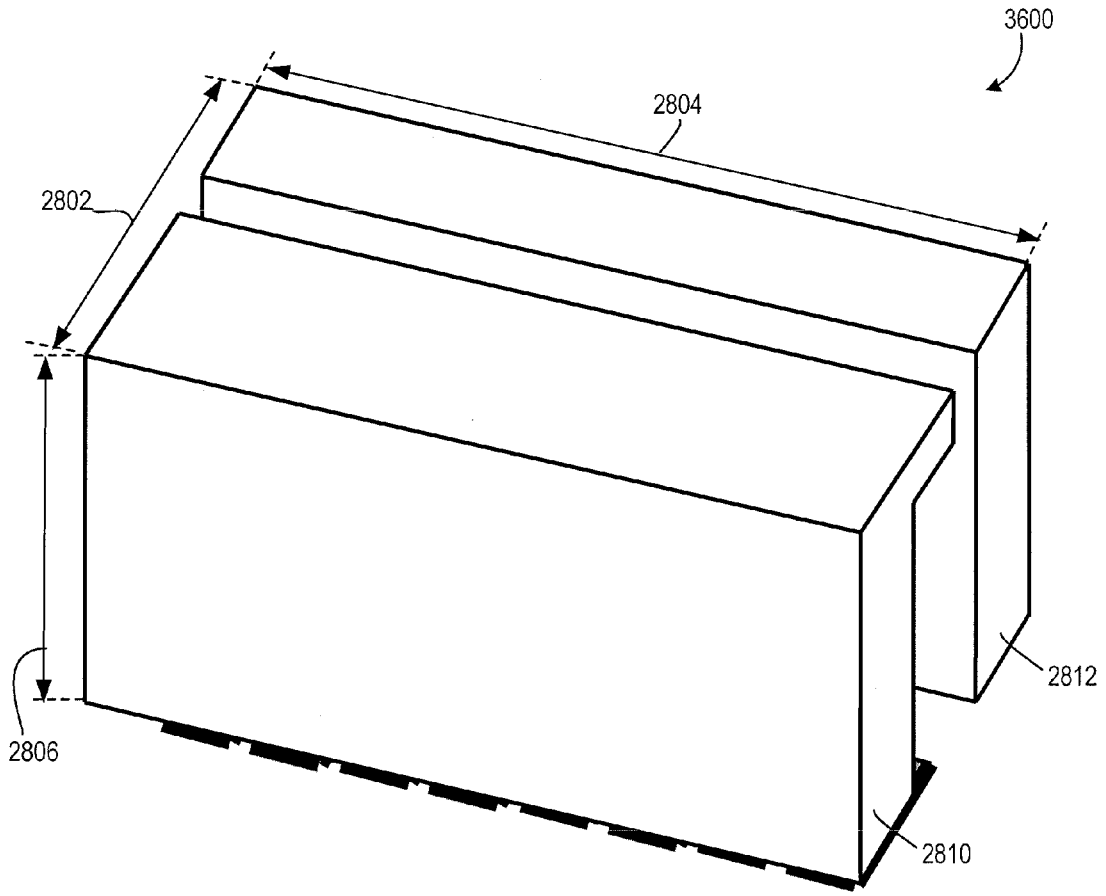
FIG. 36 is a perspective view of a multi-row coupled inductor similar to that of FIG. 28, but with first and second plates extended in the widthwise direction.

FIG. 36 is a perspective view of a multi-row coupled inductor 3600, which is similar to multi-row coupled inductor 2800 of FIG. 28, but with first plate 2810 and second plate 2812 each extending further in the widthwise 2804 direction, so that first plate 2810 provides support for third solder tab 2838 at the end of the multi-row coupled inductor. Extending the plates as shown advantageously helps prevent damage to end third solder tab 2838 during manufacturing and/or handling of multi-row coupled inductor 3600.

Figure 37:
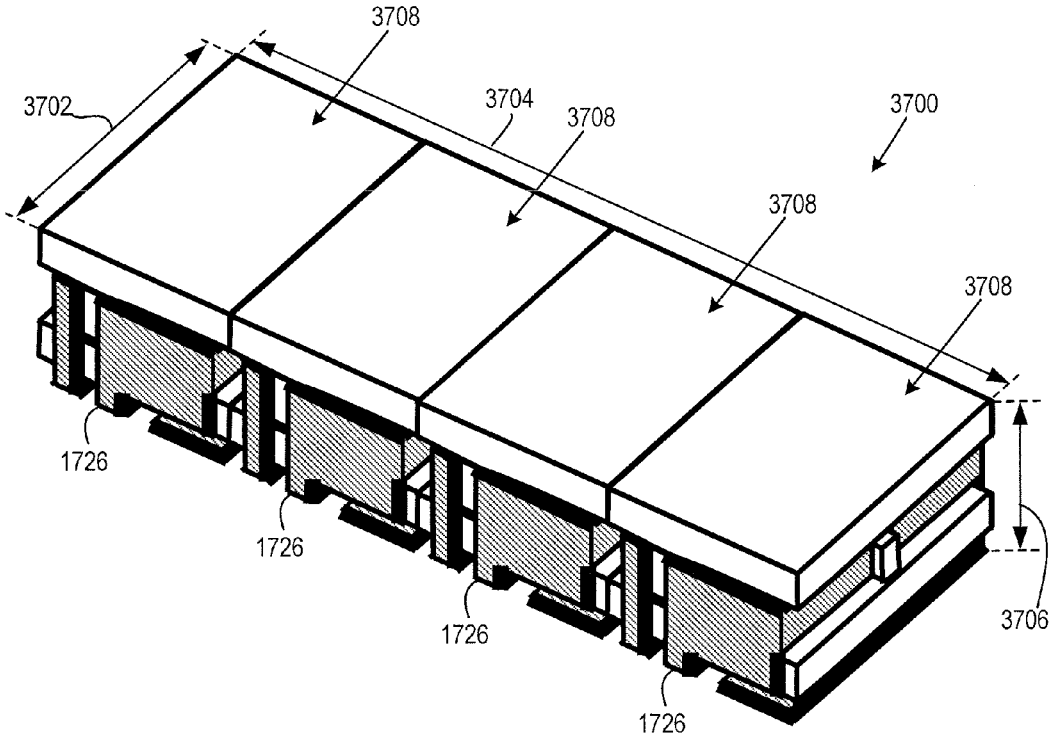
FIG. 37 is a perspective view of a scalable coupled inductor, according to an embodiment.

Multiple instances of the multi-row coupled inductors discussed above could be joined in the widthwise direction to form a scalable coupled inductor. For example, FIG. 37 is a perspective view of a scalable coupled inductor 3700 having a length 3702, a width 3704, and a height 3706 which are orthogonal to each other. Scalable coupled inductor 3700 includes a plurality of multi-row, two-winding coupled inductors 3708 joined together in the widthwise 3704 direction. The number of windings of scalable coupled inductor 3700 is equal to twice the number of instances of two-winding coupled inductor 3708. Thus, while coupled inductor 3700 is shown as including eight windings, the coupled inductor is scalable in that a desired number of windings can be achieved by joining together the appropriate number of two-winding coupled inductors 3708. For example, a four-winding multi-row coupled inductor could be obtained by joining together two instances of two-winding coupled inductor 3708 in the widthwise 3704 direction, a six-winding coupled inductor could be obtained by joining together three instances of two-winding coupled inductor 3708 in the widthwise 3704 direction, and so on.

Figure 38:
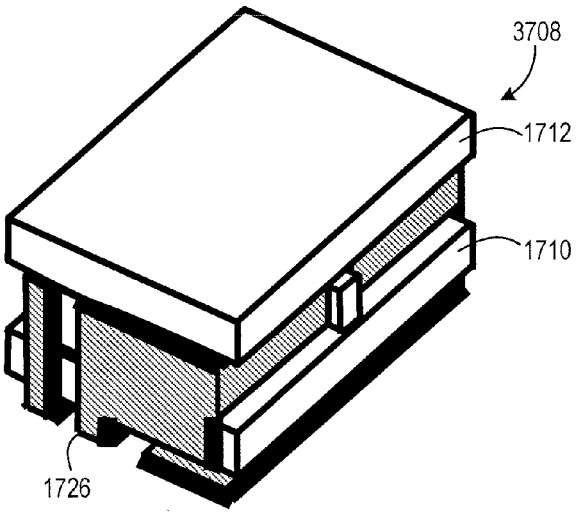
FIG. 38 is a perspective view of one instance of a multi-row, two-winding coupled inductor used in the FIG. 37 scalable coupled inductor.

FIG. 38 is a perspective view of one two-winding coupled inductor 3708 instance. Each two-winding coupled inductor 3708 is similar to multi-row coupled inductor 1900 of FIG. 19, but includes only a single pair 614 of coupling teeth instead of four pairs of coupling teeth. Additionally first plate 610 and second plate 612 are replaced with analogous but smaller first plate 1710 and second plate 1712, respectively, due to two-winding coupled inductor 3708 including only a single pair of coupling teeth. Two-winding embodiments of multi-row coupled inductor 600 or multi-row coupled inductor 2800 could also be used to form a scalable coupled inductor. Furthermore, scalable coupled inductors could alternately be formed from a plurality of multi-row coupled inductors having more than one pair of coupling teeth. For example, multiple instances of a multi-row coupled inductor 1900 embodiment including two pairs 614 of coupling teeth could be joined to form a coupled inductor including a multiple of four windings.

Figure 39:
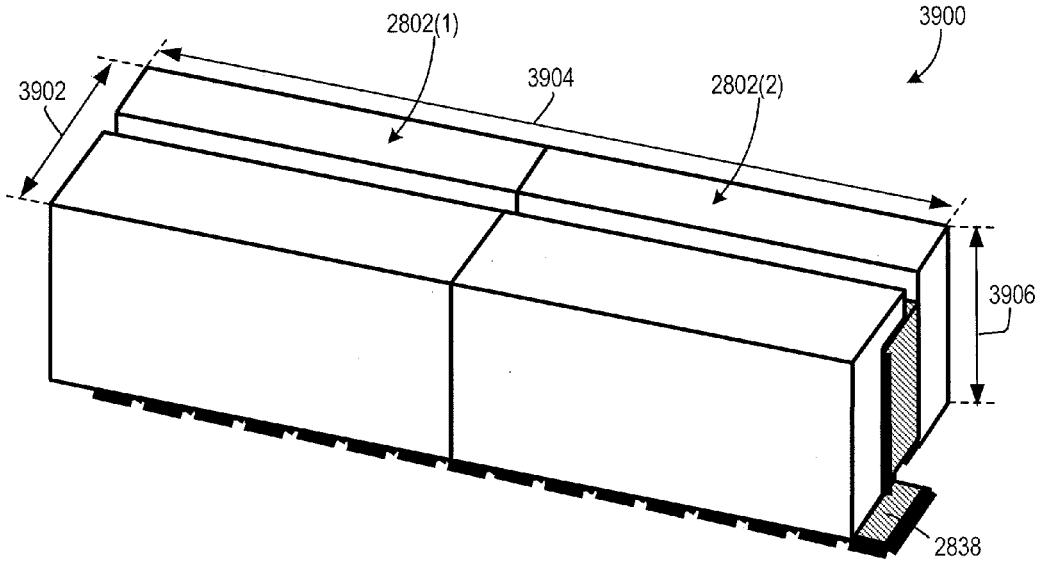
FIG. 39 is a perspective view of another scalable coupled inductor, according to an embodiment.
Figure 40:
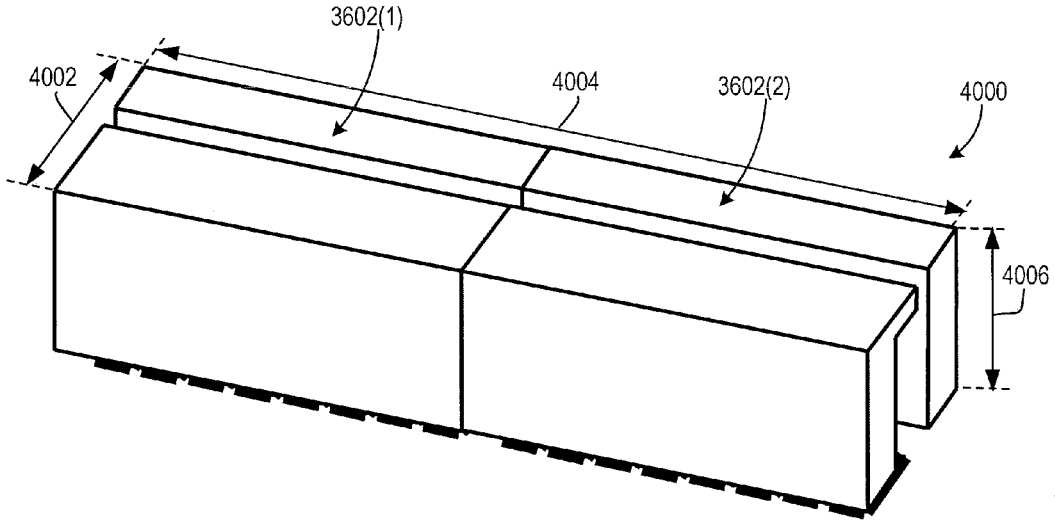
FIG. 40 is a perspective view of yet another scalable coupled inductor, according to an embodiment.
Figure 41:
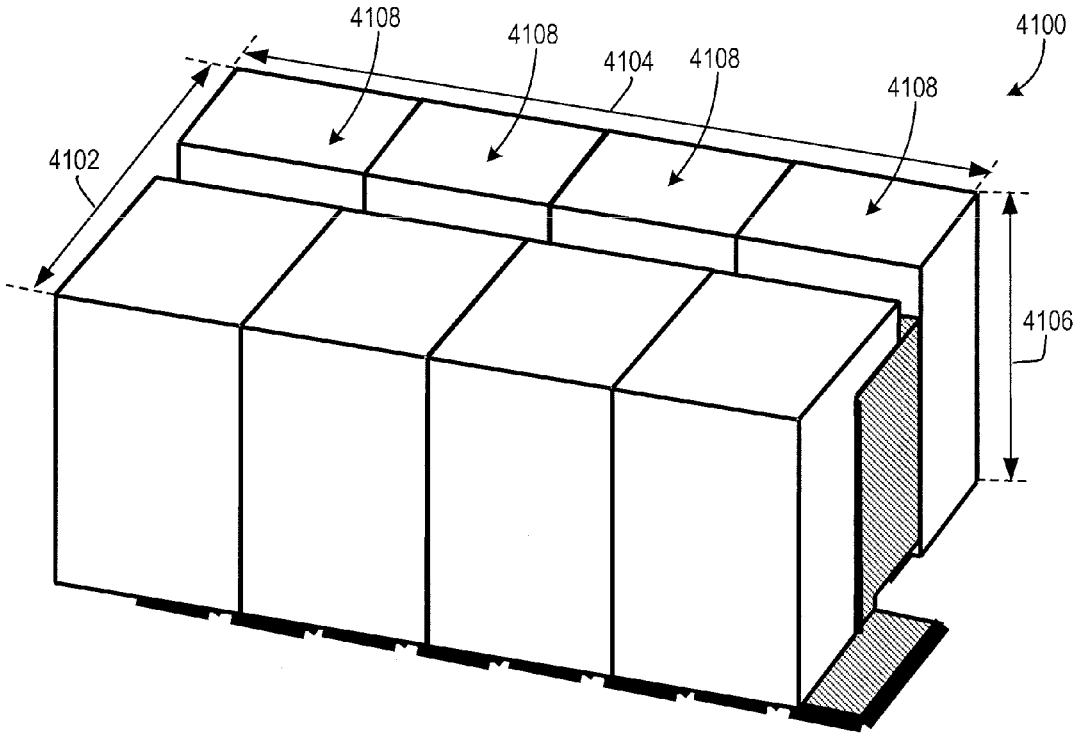
FIG. 41 is a perspective view of another scalable coupled inductor, according to an embodiment.

FIGS. 39-41 illustrate additional examples of scalable coupled inductors. In particular, FIG. 39 is a perspective view of a scalable coupled inductor 3900 having a length 3902, a width 3904, and a height 3906 which are orthogonal to each other. Scalable coupled inductor 3900 includes a first instance 2802(1) and a second instance 2802(2) of multi-row, coupled inductor 2800 joined in the widthwise 3904 direction. End third solder tab 2838 of first instance 2802(1) is disposed on first bottom outer surface 2844 of second instance 2802(2). FIG. 40, on the other hand, is a perspective view of a scalable coupled inductor 4000 having a length 4002, a width 4004, and a height 4006 which are orthogonal to each other. Scalable coupled inductor 4000 includes a first instance 3602(1) and a second instance 3602(2) of multi-row coupled inductor 3600 joined together in a widthwise 4004 direction. Although the scalable coupled inductors of FIGS. 39 and 40 each show two instances of multi-row coupled inductors joined in the widthwise direction, additional multi-row coupled inductors could be joined in the widthwise direction without departing from the scope hereof.

Figure 42:
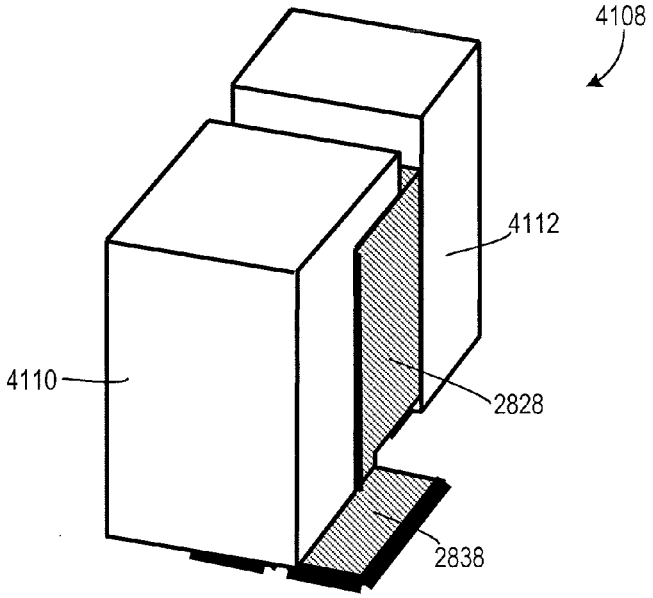
FIG. 42 is a perspective view of one instance of a multi-row, two-winding coupled inductor used in the FIG. 41 scalable coupled inductor.

FIG. 41, in turn, is a perspective view of a scalable coupled inductor 4100 having a length 4102, a width 4104, and a height 4106 which are orthogonal to each other. Scalable coupled inductor 4100 includes a plurality of multi-row, two-winding coupled inductors 4108 joined together in the widthwise 4104 direction. FIG. 42 is a perspective view of one two-winding coupled inductor 4108 instance. Each two-winding coupled inductor 4108 is similar to multi-row coupled inductor 2800 of FIG. 28, but includes only a single pair 2814 of coupling teeth. Additionally first plate 2810 and second plate 2812 have been replaced with analogous but smaller first plate 4110 and second plate 4112, respectively, due to two-winding coupled inductor 4108 including only a single pair of coupling teeth.

Use of a plurality of multi-row coupled inductors joined together to achieve a desired number of windings, instead a single multi-row coupled inductor having the desired number of windings, may achieve a number of advantages. For example, a multi-row coupled inductor having a minimal number of windings, such as two windings, may be used as a building block for coupled inductors having an arbitrary number of windings, thereby minimizing the number of different component types required to establish a family of coupled inductors. As another example, small multi-row coupled inductors are typically easier to manufacture than large multi-row coupled inductors, and production yield for a given coupled inductor may be higher if the coupled inductor is formed from a number of small multi-row coupled inductors, instead of forming a single large coupled inductor having the desired number of windings.

The various magnetic core elements of the multi-row coupled inductors may be combined in various manners without departing from the scope hereof. For example, in some embodiments of multi-row coupled inductor 600 of FIG. 6, first plate 610, second plate 612, first coupling teeth 616, second coupling teeth 618, and leakage tooth 650 are part of a monolithic (single piece) magnetic core. As another example, in some other embodiments, first plate 610, second plate 612, first coupling teeth 616, and leakage tooth 650 are part of a monolithic first magnetic element, while second plate 612 is a separate magnetic element joined to the monolithic first magnetic element to complete magnetic core 608. Examples of magnetic materials that may be used to form the magnetic cores disclosed herein include, but are not limited to, ferrite materials and powder iron materials.

Figure 43:
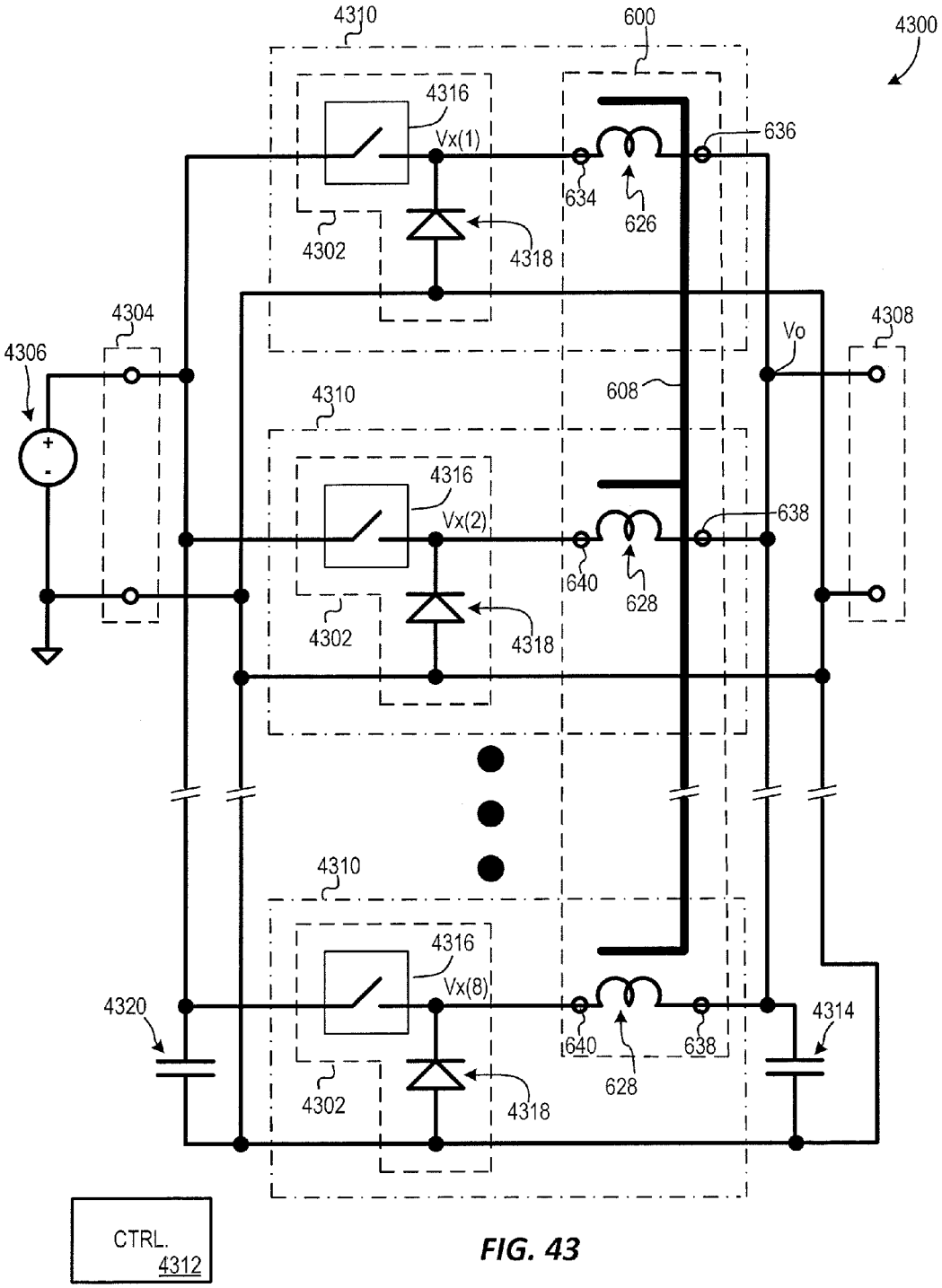
FIG. 43 illustrates a multi-phase buck converter including the multi-row coupled inductor of FIG. 6, according to an embodiment.

One possible application of the multi-row coupled inductors is in multi-phase switching power converter applications, including but not limited to, multi-phase buck converter applications, multi-phase boost converter applications, or multi-phase buck-boost converter applications. For example, FIG. 43 illustrates one possible use of coupled inductor 600 (FIG. 6) in a multi-phase buck converter 4300. Each first winding 626 and each second winding 628 is electrically coupled between a respective switching node $V_x$ and a common output node $V_o$. In this document, specific instances of switching nodes $V_x$ may be referred to by use of a numeral in parentheses, (e.g., switching node $V_x$ (1)). First and fourth solder tabs 634 and 640 are electrically coupled to respective switching nodes $V_x$, and second and third solder tabs 636 and 638 are electrically coupled to common output node $V_o$, to achieve inverse magnetic coupling. In certain alternate embodiments, however, second and third solder tabs 636 and 638 are electrically coupled to respective switching nodes $V_x$, and first and fourth solder tabs 634 and 640 are electrically coupled to common output node $V_o$, while still achieving inverse magnetic coupling. A respective switching circuit 4302 is electrically coupled to each switching node V. Each switching circuit 4302 is electrically coupled to an input port 4304, which is in turn electrically coupled to an electric power source 4306. An output port 4308 is electrically coupled to output node $V_o$. Each switching circuit 4302 and respective inductor is collectively referred to as a "phase" 4310 of the converter. Thus, multi-phase buck converter 4300 is an eight-phase converter, although only three of the eight phases 4310 are shown in FIG. 43 to promote illustrative clarity.

A controller 4312 causes each switching circuit 4302 to repeatedly switch its respective winding end between electric power source 4306 and ground, thereby switching its winding end between two different voltage levels, to transfer power from electric power source 4306 to a load (not shown) electrically coupled across output port 4308. Controller 4312 typically causes switching circuits 4302 to switch at a relatively high frequency, such as at 100 kilohertz or greater, to promote low ripple current magnitude and fast transient response, as well as to ensure that switching induced noise is at a frequency above that perceivable by humans. Additionally, in certain embodiments, controller 4312 causes switching circuits 4302 to switch out-of-phase with respect to each other in the time domain to improve transient response and promote ripple current cancellation in output capacitors 4314.

Each switching circuit 4302 includes a control switching device 4316 that alternately switches between its conductive and non-conductive states under the command of controller

4312. Each switching circuit 4302 further includes a freewheeling device 4318 adapted to provide a path for current through its respective winding 626 or 628 when the control switching device 4316 of the switching circuit transitions from its conductive to non-conductive state. Freewheeling devices 4318 may be diodes, as shown, to promote system simplicity. However, in certain alternate embodiments, freewheeling devices 4318 may be supplemented by or replaced with a switching device operating under the command of controller 4312 to improve converter performance. For example, diodes in freewheeling devices 4318 may be supplemented by switching devices to reduce freewheeling device 4318 forward voltage drop. In the context of this disclosure, a switching device includes, but is not limited to, a bipolar junction transistor, a field effect transistor (e.g., a N-channel or P-channel metal oxide semiconductor field effect transistor, a junction field effect transistor, a metal semiconductor field effect transistor), an insulated gate bipolar junction transistor, a thyristor, or a silicon controlled rectifier.

Controller 4312 is optionally configured to control switching circuits 4302 to regulate one or more parameters of multiphase buck converter 4300, such as input voltage, input current, input power, output voltage, output current, or output power. Buck converter 4300 typically includes one or more input capacitors 4320 electrically coupled across input port 4304 for providing a ripple component of switching circuit 4302 input current. Additionally, one or more output capacitors 4314 are generally electrically coupled across output port 4308 to shunt ripple current generated by switching circuits 4302.

Buck converter 4300 could be modified to have a different number of phases. For example, converter 4300 could be modified to have only two phases and use a two-winding embodiment of multi-row coupled inductor 600. Buck converter 4300 could also be modified to use one of the other multi-tow coupled inductors disclosed herein, such as inductor 1900, 2100, 2800, 3600, 3700, 3900, 4000, or 4100. Additionally, buck converter 4300 could also be modified to have a different multi-phase switching power converter topology, such as that of a multi-phase boost converter or a multi-phase buck-boost converter, or an isolated topology, such as a flyback or forward converter without departing from the scope hereof.

Combinations of Features

Features described above as well as those claimed below may be combined in various ways without departing from the scope hereof. The following examples illustrate some possible combinations:

(A1) A multi-row coupled inductor having length, width, and height may include a magnetic core including: (1) opposing first and second plates separated from each other in the height direction, and (2) one or more pairs of coupling teeth. Each of the one or more pairs of coupling teeth may be separated from each other in the widthwise direction. Each of the one or more pairs of coupling teeth may include a first coupling tooth and a second coupling tooth separated from and opposing each other in the lengthwise direction. A respective first winding may be wound around the first coupling tooth of each of the one or more pairs, and a respective second winding may be wound around the second coupling tooth of each of the one or more pairs. The first winding may mirror the second winding in each of the one or more pairs, when seen looking toward the magnetic core cross-sectionally in the height direction.

(A2) In the multi-row coupled inductor denoted as (A1), the first plate may include: (1) opposing first and second side outer surfaces separated from each other in the lengthwise direction, and (2) a bottom outer surface joining the first and second side outer surfaces in the lengthwise direction. Opposing ends of each first winding may wrap around the first outer side surface to form respective first and second solder tabs on the bottom outer surface, and opposing ends of each second winding may wrap around the second side outer surface to form respective third and fourth solder tabs on the bottom outer surface.

(A3) In the multi-row coupled inductor denoted as (A2), each first, second, third, and fourth solder tab may at least partially overlap with each other when seen looking toward the magnetic core cross-sectionally in the widthwise direction.

(A4) In any of the multi-row coupled inductors denoted as (A1) through (A3), the first coupling teeth of the one or more pairs may collectively form a first row of coupling teeth in the widthwise direction, and the second coupling teeth of the one or more pairs may collectively form a second row coupling teeth in the widthwise direction. The magnetic core may further include a leakage tooth disposed, in the lengthwise direction, between the first and second rows, where the leakage tooth is further disposed between the first and second plates in the height direction.

(A5) In any of the multi-row coupled inductors denoted as (A1) through (A4), the one or more pairs of coupling teeth may include a plurality of pairs of coupling teeth.

(B1) A multi-row coupled inductor having length, width, and height may include a magnetic core including: (1) opposing first and second plates separated from each other in the height direction, and (2) first and second coupling teeth separated from and opposing each other in the lengthwise direction. Each of the first and second coupling teeth may be disposed between the first and second plates in the height direction. The multi-row coupled inductor may further include a first winding wound around the first coupling tooth and a second winding wound around the second coupling tooth. Opposing ends of the first winding may form first and second solder tabs, respectively, and opposing ends of the second winding may form third and fourth solder tabs, respectively. Each of the first, second, third, and fourth solder tabs may at least partially overlap with each other when seen looking toward the magnetic core cross-sectionally in the widthwise direction.

(B2) In the multi-row coupled inductor denoted as (B1), the first plate may include: (1) opposing first and second side outer surfaces separated from each other in the lengthwise direction, and (2) a bottom outer surface joining the first and second side outer surfaces in the lengthwise direction. The first winding may wrap around the first outer side surface to form the first and second solder tabs on the bottom outer surface, and the second winding may wrap around the second side outer surface to form the third and fourth solder tabs on the bottom outer surface.

(B3) In either of the multi-row coupled inductors denoted as (B1) or (B2), the third solder tab may be disposed, in the widthwise direction, between the first and second solder tabs, and the second solder tab may be disposed, in the widthwise direction, between the third and fourth solder tabs.

(B4) In any of the multi-row coupled inductors denoted as (B1) through (B3), the first winding may have a first U-shaped cross-section, as seen looking toward the magnetic core cross-sectionally in the height direction, and the second winding may have a second U-shaped cross-section, as seen when looking toward the magnetic core cross-sectionally in the height direction. The second U-shaped cross-section may be rotated by about one hundred eighty degrees with respect to the first U-shaped cross-section, as seen when looking toward the magnetic core cross-sectionally in the height direction.

(B5) In any of the multi-row coupled inductors denoted as (B1) through (B4), the magnetic core may further include a leakage tooth disposed, in the lengthwise direction, between the first and second coupling teeth, and the leakage tooth may be further disposed between the first and second plates in the height direction.

(B6) In any of the multi-row coupled inductors denoted as (B1) through (B5): (1) the first winding may have a substantially rectangular cross-section, (2) a thickness of the first winding may be orthogonal to the height direction along portions of the first winding wound around the first coupling tooth, (3) the second winding may have a substantially rectangular cross-section, and (4) a thickness of the second winding may be orthogonal to the height direction along portions of the second winding wound around the second coupling tooth.

(C1) A scalable coupled inductor having length, width, and height may include a plurality of multi-row coupled inductors joined in the width direction. Each of the plurality of multi-row coupled inductors may include a magnetic core including: (1) opposing first and second plates separated from each other in the height direction, and (2) first and second coupling teeth separated from and opposing each other in the lengthwise direction. In each of the plurality of multi-row coupled inductors: (1) each of the first and second coupling teeth may be disposed between the first and second plates in the height direction, (2) a first winding may be wound around the first coupling tooth, and a (3) second winding may be wound around the second coupling tooth.

(C2) In each of the plurality of multi-row coupled inductors of the scalable coupled inductor denoted as (C1): (1) opposing ends of the first winding may form first and second solder tabs, respectively, (2) opposing ends of the second winding may form third and fourth solder tabs, respectively, and (3) each of the first, second, third, and fourth solder tabs may overlap with each other when seen looking toward the magnetic core cross-sectionally in the widthwise direction.

(C3) In each of the plurality of multi-row coupled inductors in either of scalable coupled inductors denoted as (C1) or (C2), the first winding may mirror the second winding, when looking toward the magnetic core cross-sectionally in the height direction.

(C4) In each of the plurality of multi-row coupled inductors in any of the scalable coupled inductors denoted as (C1) through (C3), opposing ends of the first winding may be interdigitated with opposing ends of the second winding.

(D1) A multi-row coupled inductor having length, width, and height may include a magnetic core including: (1) opposing first and second plates separated from each other in the length direction, (2) a first row of one or more first coupling teeth, and (3) a second row of one of more second coupling teeth. The first and second rows may be separated from and oppose each other in the height direction, and each first coupling tooth and each second coupling tooth may be disposed between the first and second plates in the length direction. A respective first winding may be wound around each of the one or more first coupling teeth of the first row, and a respective second winding may be wound around each of the one or more second coupling teeth of the second row. Opposing ends of each first winding may terminate on a common side of the magnetic core, and opposing ends of each second winding may terminate on the common side of the magnetic core.

(D2) In the multi-row coupled inductor denoted as (D1): (1) opposing ends of each first winding may form first and second solder tabs, respectively, (2) opposing ends of each second winding may form third and fourth solder tabs, respectively, and (3) each first, second, third, and fourth solder tab may be disposed in a common plane in the lengthwise by widthwise directions.

(D3) In the multi-row coupled inductor denoted as (D2): (1) the first plate may form a first bottom outer surface in the length by width directions, (2) the second plate may form a second bottom outer surface in the length by width directions, (3) each first solder tab may be disposed on the first bottom outer surface, (4) each second solder tab and each fourth solder tab may be disposed on the second bottom outer surface.

(D4) In either of the multi-row coupled inductors denoted as (D2) or (D3), each first solder tab and each third solder tab may at least partially overlap with each other, and each second solder tab and each fourth solder tab may at least partially overlapping each other, when seen looking toward the magnetic core cross-sectionally in the widthwise direction.

(D5) In any of the multi-row coupled inductors denoted as (D1) through (D4), the magnetic core may further include a leakage tooth disposed between the first and second plates in the lengthwise direction, where the leakage tooth is disposed over both of the first and second rows, when seen looking toward the magnetic core in the height direction.

(E1) A multi-phase switching power converter may include a multi-row coupled inductor having length, width, and height. The multi-row coupled inductor may include a magnetic core including: (1) opposing first and second plates separated from each other in the height direction, and (2) one or more pairs of coupling teeth. Each of the one or more pairs of coupling teeth may be separated from each other in the widthwise direction, and each of the one or more pairs may include a first coupling tooth and a second coupling tooth separated from and opposing each other in the lengthwise direction. The multi-row coupled inductor may further include: (1) a respective first winding wound around the first coupling tooth of each of the one or more pairs, and (2) a respective second winding wound around the second coupling tooth of each of the one or more pairs. The first winding may mirror the second winding in each of the one or more pairs, when seen looking toward the magnetic cross-sectionally in the height direction. The multi-phase switching power converter may further include: (1) a respective first switching circuit electrically coupled to an end of each first winding and adapted to repeatedly switch the end between at least two different voltage levels, and (2) a respective second switching circuit electrically coupled to an end of each second winding and adapted to repeatedly switch the end between at least two different voltage levels.

(E2) The multi-phase switching power converter denoted as (E1) may further include a controller adapted to control each first and second switching circuit such that each first and second switching circuit switches out of phase with respect to each other.

(E3) In either of the multi-phase switching power converters denoted as (E1) or (E2): (1) the first plate may include (i) opposing first and second side outer surfaces separated from each other in the lengthwise direction, and (ii) a bottom outer surface joining the first and second side outer surfaces in the lengthwise direction; (2) opposing ends of each first winding may wrap around the first outer side surface to form respective first and second solder tabs on the bottom outer surface; and (3) opposing ends of each second winding may wrap around the second side outer surface to form respective third and fourth solder tabs on the bottom outer surface.

(E4) In the multi-phase switching power converter denoted as (E3), each first, second, third, and fourth solder tab may at least partially overlap with each other when seen looking toward the magnetic core cross-sectionally in the widthwise direction.

(F1) A multi-phase switching power converter may include a multi-row coupled inductor having length, width, and height. The multi-row coupled inductor may include a magnetic core including: (1) opposing first and second plates separated from each other in the height direction, and (2) first and second coupling teeth separated from and opposing each other in the lengthwise direction. Each of the first and second coupling teeth may be disposed between the first and second plates in the height direction. The multi-row coupled inductor may further include a first winding wound around the first coupling tooth and a second winding wound around the second coupling tooth. Opposing ends of the first winding may form first and second solder tabs, respectively, and opposing ends of the second winding may form third and fourth solder tabs, respectively. Each of the first, second, third, and fourth solder tabs may at least partially overlap with each other when seen looking toward the magnetic core cross-sectionally in the widthwise direction. The multi-phase switching power converter may further include a first and a second switching circuit. The first and second switching circuit may each be adapted to repeatedly switch an end of a respective one of the first and second windings between at least two different voltage levels.

(F2) The multi-phase switching power converter denoted as (F1) may further include a controller adapted to control each of the first and second switching circuits such that each of the first and second switching circuits switches out of phase with respect to each other.

(F3) In either of the multi-phase switching power converters denoted as (F1) or (F2): (1) the first plate may include (i) opposing first and second side outer surfaces separated from each other in the lengthwise direction, and (ii) a bottom outer surface joining the first and second side outer surfaces in the lengthwise direction; (2) the first winding may wrap around the first outer side surface to form the first and second solder tabs on the bottom outer surface; and (3) the second winding may wrap around the second side outer surface to form the third and fourth solder tabs on the bottom outer surface.

(F4) In any of the multi-phase switching power converters denoted as (F1) through (F3): (1) the third solder tab may be disposed, in the widthwise direction, between the first and second solder tabs, and (2) the second solder tab may be disposed, in the widthwise direction, between the third and fourth solder tabs.

(G1) A multi-phase switching power converter may include a multi-row coupled inductor having length, width, and height. The multi-row coupled inductor may include a magnetic core including: (1) opposing first and second plates separated from each other in the length direction, (2) a first row of one or more first coupling teeth, and (3) a second row of one of more second coupling teeth. The first and second rows may be separated from and oppose each other in the height direction, and each first coupling tooth and each second coupling tooth may be disposed between the first and second plates in the length direction. A respective first winding may be wound around each of the one or more first coupling teeth of the first row, and a respective second winding may be wound around each of the one or more second coupling teeth of the second row. Opposing ends of each first winding may terminate on a common side of the magnetic core, and opposing ends of each second winding may terminate on the common side of the magnetic core. The multi-phase switching power converter may further include: (1) a respective first switching circuit electrically coupled to an end of each first winding and adapted to repeatedly switch the end of the first winding between at least two different voltage levels, and (2) a respective second switching circuit electrically coupled to an end of each second winding and adapted to repeatedly switch the end of the second winding between at least two different voltage levels.

(G2) The multi-phase switching power converter denoted as (G1) may further include a controller adapted to control each first and second switching circuit such that each first and second switching circuit switches out of phase with respect to each other.

(G3) In either of the multi-phase switching power converters denoted as (G1) or (G2): (1) opposing ends of each first winding may form first and second solder tabs, respectively; (2) opposing ends of each second winding may form third and fourth solder tabs, respectively; and (3) each first, second, third, and fourth solder tab may be disposed in a common plane in the lengthwise by widthwise directions.

(G4) In the multi-phase switching power converter denoted as (G3): (1) the first plate may form a first bottom outer surface in the length by width directions, (2) the second plate may form a second bottom outer surface in the length by width directions, (3) each first solder tab may be disposed on the first bottom outer surface, and (4) each second solder tab and each fourth solder tab may be disposed on the second bottom outer surface.

(G5) In either of the multi-phase switching power converters denoted as (G3) or (G4), each first solder tab and each third solder tab may at least partially overlap with each other, and each second solder tab and each fourth solder tab may at least partially overlap each other, when seen looking toward the magnetic core cross-sectionally in the widthwise direction.

(G6) In any of the multi-phase switching power converters denoted as (G1) through (G5): (1) the magnetic core may further include a leakage tooth disposed between the first and second plates in the lengthwise direction, and (2) the leakage tooth may be disposed over both of the first and second rows, when seen looking toward the magnetic core in the height direction.

Changes may be made in the above devices, methods, and systems without departing from the scope hereof. For example, solder tabs could be replaced with alternative conductor types, such as through-hole pins or socket pins. Therefore, the matter contained in the above description and shown in the accompanying drawings should be interpreted as illustrative and not in a limiting sense. The following claims are intended to cover generic and specific features described herein, as well as all statements of the scope of the present devices, methods, and systems, which, as a matter of language, might be said to fall therebetween.

What is claimed is:

1. A multi-row coupled inductor having length, width, and height, comprising:

a magnetic core, including:

opposing first and second plates separated from each other in the height direction, the first plate including (a) opposing first and second side outer surfaces separated from each other in the lengthwise direction and (b) a bottom outer surface joining the first and second side outer surfaces in the lengthwise direction, and one or more pairs of coupling teeth, each of the one or more pairs separated from each other in the widthwise direction, each of the one or more pairs including a first coupling tooth and a second coupling tooth separated from and opposing each other in the lengthwise direction; and a respective first winding wound around the first coupling tooth of each of the one or more pairs, opposing ends of each first winding wrapping around the first side outer surface to form respective first and second solder tabs on the bottom outer surface; and a respective second winding wound around the second coupling tooth of each of the one or more pairs, opposing ends of each second winding wrapping around the second side outer surface to form respective third and fourth solder tabs on the bottom outer surface;

the first winding mirroring the second winding in each of the one or more pairs, when seen looking toward the magnetic core cross-sectionally in the height direction;

each first, second, third, and fourth solder tab at least partially overlapping with each other when seen looking toward the magnetic core cross-sectionally in the widthwise direction.

2. The multi-row coupled inductor of claim 1, wherein:

the first coupling teeth of the one or more pairs collectively form a first row of coupling teeth in the widthwise direction;

the second coupling teeth of the one or more pairs collectively form a second row coupling teeth in the widthwise direction; and the magnetic core further includes a leakage tooth disposed, in the lengthwise direction, between the first and second rows, the leakage tooth further disposed between the first and second plates in the height direction.

3. The multi-row coupled inductor of claim 2, the one or more pairs of coupling teeth comprising a plurality of pairs of coupling teeth.

4. A multi-row coupled inductor having length, width, and height, comprising:

a magnetic core, including:

opposing first and second plates separated from each other in the height direction, the first plate including (a) opposing first and second side outer surfaces separated from each other in the lengthwise direction and (b) a bottom outer surface joining the first and second side outer surfaces in the lengthwise direction, and first and second coupling teeth separated from and opposing each other in the lengthwise direction, each of the first and second coupling teeth disposed between the first and second plates in the height direction;

a first winding wound around the first coupling tooth and wrapping around the first outer side surface such that opposing ends of the first winding form first and second solder tabs, respectively, on the bottom outer surface; and a second winding wound around the second coupling tooth and wrapping around the second side outer surface such that opposing ends of the second winding form third and fourth solder tabs, respectively, on the bottom outer surface;

the third solder tab being disposed, in the widthwise direction, between the first and second solder tabs on the bottom outer surface;

the second solder tab being disposed, in the widthwise direction, between the third and fourth solder tabs on the bottom outer surface.

5. The multi-row coupled inductor of claim 4, wherein:

the first winding has a first U-shaped cross-section, as seen looking toward the magnetic core cross-sectionally in the height direction;

the second winding has a second U-shaped cross-section, as seen when looking toward the magnetic core cross-sectionally in the height direction; and the second U-shaped cross-section is rotated by about one hundred eighty degrees with respect to the first U-shaped cross-section, as seen when looking toward the magnetic core cross-sectionally in the height direction.

6. The multi-row coupled inductor of claim 4, the magnetic core further including a leakage tooth disposed, in the lengthwise direction, between the first and second coupling teeth, the leakage tooth further disposed between the first and second plates in the height direction.

7. The multi-row coupled inductor of claim 4, wherein:

the first winding has a substantially rectangular cross-section and a thickness of the first winding is orthogonal to the height direction along portions of the first winding wound around the first coupling tooth; and the second winding has a substantially rectangular cross-section and a thickness of the second winding is orthogonal to the height direction along portions of the second winding wound around the second coupling tooth.

8. The multi-row coupled inductor of claim 4, each of the first, second, third, and fourth solder tabs at least partially overlapping with each other when seen looking toward the magnetic core cross-sectionally in the widthwise direction.

9. A multi-row coupled inductor having length, width, and height, comprising:

a magnetic core, including:

opposing first and second plates separated from each other in the height direction, the first plate including (a) opposing first and second side outer surfaces separated from each other in the lengthwise direction and (b) a bottom outer surface joining the first and second side outer surfaces in the lengthwise direction, and one or more pairs of coupling teeth, each of the one or more pairs separated from each other in the widthwise direction, each of the one or more pairs including a first coupling tooth and a second coupling tooth separated from and opposing each other in the lengthwise direction;

a respective first winding wound around the first coupling tooth of each of the one or more pairs, opposing ends of each first winding wrapping around the first side outer surface to form respective first and second solder tabs on the bottom outer surface; and a respective second winding wound around the second coupling tooth of each of the one or more pairs, opposing ends of each second winding wrapping around the second side outer surface to form respective third and fourth solder tabs on the bottom outer surface;

each of the first and second solder tabs being offset from each of the third and fourth solder tabs in the widthwise direction.

10. The multi-row coupled inductor of claim 9, wherein:

each first, second, and fourth solder tab at least partially overlaps with each other when seen looking toward the magnetic core cross-sectionally in the widthwise direction;

each second, third and fourth solder tab at least partially overlaps with each other when seen looking toward the magnetic core cross-sectionally in the widthwise direction;

each first and second solder tab at least partially overlaps with each other when seen looking toward the magnetic core cross-sectionally in the lengthwise direction; and each third and fourth solder tab at least partially overlaps with each other when seen looking toward the magnetic core cross-sectionally in the lengthwise direction.

11. The multi-row coupled inductor of claim 10, wherein, for each of the one or more pairs:

the first winding has a first cross-section, as seen looking toward the magnetic core cross-sectionally in the height direction;

the second winding has a second cross-section, as seen when looking toward the magnetic core cross-sectionally in the height direction; and the second cross-section is rotated by about one hundred eighty degrees with respect to the first cross-section, as seen when looking toward the magnetic core cross-sectionally in the height direction.

12. The multi-row coupled inductor of claim 10, the magnetic core further including a leakage tooth disposed, in the lengthwise direction, between the first and second coupling teeth, the leakage tooth further disposed between the first and second plates in the height direction.

13. The multi-row coupled inductor of claim 10, wherein, for each of the one or more pairs:

the first winding has a substantially rectangular cross-section and a thickness of the first winding is orthogonal to the height direction along portions of the first winding wound around the first coupling tooth; and the second winding has a substantially rectangular cross-section and a thickness of the second winding is orthogonal to the height direction along portions of the second winding wound around the second coupling tooth.

* * * * *